US012016504B2

(12) United States Patent
Kessler et al.

(10) Patent No.: US 12,016,504 B2
(45) Date of Patent: Jun. 25, 2024

(54) MONITORING OF A WASHING PROGRAM OF A DISHWASHER MACHINE

(71) Applicant: Henkel AG & Co. KGaA, Duesseldorf (DE)

(72) Inventors: Arnd Kessler, Monheim am Rhein (DE); Lars Zuechner, Langenfeld (DE); Robert Ruiz Hernandez, Duesseldorf (DE); Thomas Juckel, Monheim (DE); Wolfgang Wick, Dormagen (DE)

(73) Assignee: HENKEL AG & CO. KGAA, Duesseldorf, NY (US)

( * ) Notice: Subject to any disclaimer, the term of this patent is extended or adjusted under 35 U.S.C. 154(b) by 580 days.

(21) Appl. No.: 17/044,248

(22) PCT Filed: Jun. 26, 2019

(86) PCT No.: PCT/EP2019/066953
§ 371 (c)(1),
(2) Date: Sep. 30, 2020

(87) PCT Pub. No.: WO2020/002400
PCT Pub. Date: Jan. 2, 2020

(65) Prior Publication Data

US 2021/0204791 A1 Jul. 8, 2021

(30) Foreign Application Priority Data

Jun. 27, 2018 (DE) ..... 10 2018 210 496.4

(51) Int. Cl.
*A47L 15/44* (2006.01)
*A47L 15/00* (2006.01)
*A47L 15/42* (2006.01)

(52) U.S. Cl.
CPC ..... *A47L 15/0055* (2013.01); *A47L 15/0023* (2013.01); *A47L 15/0026* (2013.01);
(Continued)

(58) Field of Classification Search
None
See application file for complete search history.

(56) References Cited

U.S. PATENT DOCUMENTS 10,012,971 B2 7/2018 Pietsch et al.
11,547,270 B2 * 1/2023 Kessler ..... A47L 15/44
(Continued)

FOREIGN PATENT DOCUMENTS

DE 10204455 A1 8/2003
DE 102007042863 A1 3/2009
(Continued)

OTHER PUBLICATIONS

Translation of DE102016225812 by Kessler et al., published Jun. 21, 2018.*
(Continued)

*Primary Examiner* — Mikhail Kornakov
*Assistant Examiner* — Ryan L Coleman
(74) *Attorney, Agent, or Firm* — Lorenz & Kopf, LLP

(57) ABSTRACT

Among other things, a method is disclosed which includes the following: acquiring at least one set of acceleration data indicative of a progression of measured acceleration values; determining status data indicative of a process step within a cleaning program performed by a dishwasher; outputting or causing the output of the determined status data. Further revealed is a device for executing and/or controlling this method, a system with one or more devices for executing and/or controlling this method and a computer program for executing and/or controlling this method by employing a processor.

14 Claims, 11 Drawing Sheets

(52) U.S. Cl.
CPC ..... *A47L 15/0028* (2013.01); *A47L 15/0034* (2013.01); *A47L 15/0063* (2013.01); *A47L 15/4287* (2013.01); *A47L 15/449* (2013.01); *A47L 2401/03* (2013.01); *A47L 2401/12* (2013.01); *A47L 2401/20* (2013.01); *A47L 2401/32* (2013.01); *A47L 2501/07* (2013.01); *A47L 2501/26* (2013.01)

(56) References Cited

U.S. PATENT DOCUMENTS

| | | | | |
|---|---|---|---|---|
| 2011/0180118 | A1 | 7/2011 | Schrott | |
| 2013/0268134 | A1* | 10/2013 | Tuller | F25D 29/00 700/291 |
| 2016/0143505 | A1 | 5/2016 | Van Tol et al. | |

FOREIGN PATENT DOCUMENTS

| | | | |
|---|---|---|---|
| DE | 102008036586 | A1 | 2/2010 |
| DE | 102008045087 | A1 | 3/2010 |
| DE | 102012222196 | * | 1/2014 |
| DE | 102016225812 | * | 6/2018 |
| DE | 102016225812 | A1 | 6/2018 |
| EP | 2662014 | * | 5/2012 |
| EP | 2918214 | A2 | 9/2015 |
| WO | 2015036229 | A1 | 3/2015 |

OTHER PUBLICATIONS

Translation of DE102007042863 by Kessler, published Mar. 12, 2009.*
Translation of DE102008036586 by Schrott, published Feb. 11, 2010.*
Translation of DE102012222196 by Hain, published Jan. 2, 2014.*
Translation of DE10204455 by Asmann, published Aug. 21, 2003.*
Norm ISO 11784 Aug. 15, 1996. Radio frequency Identification of animals—Code structure. S. 1-2.
Norm ISO 11784 AMD 1 Nov. 15, 2004. Radio frequency identification of animals—Code structure; Amendment 1. S. 1-2.
Norm ISO 11784 AMD 2 Jun. 1, 2010. Radio frequency identification of animals—Code structure; Amendment 2: Indication of an advanced transponder.
Norm ISO 11785 Oct. 15, 1996. Radio frequency identification of animals—Technical concept. S. 1-13.
Norm ISO 11785 Technical corrigendum 1 Dec. 15, 2008. Identification des animaux par radiofrequence—Concept technique; Rectificatif Technique 1 1 S.
Norm ISO 11898-1 2015-12-00. Road vehicles—Controller area network (CAN)—Part 1: Data link layer and physical Signalling. S. 1-65.
Norm ISO/IEC 14443-2 Jul. 15, 2016. Identification cards—Contactless integrated circuit cards—Proximity cards—Part 2: Radio frequency power and Signal Interface. S. 1-44.
Norm ISO/IEC 15693-1 Oct. 1, 2010. Identification cards—Contactless integrated circuit cards—Vicinity cards—Part 1: Physical characteristics. S. 1-5.
Norm ISO/IEC 18000-1 Jul. 1, 2008. Information technology—Radio frequency Identification for item management—Part 1: Reference architecture and definition of Parameters to be standardized. S. 1-48.

* cited by examiner

MONITORING OF A WASHING PROGRAM OF A DISHWASHER MACHINE

CROSS-REFERENCE TO RELATED APPLICATION

This application is a U.S. National-Stage entry under 35 U.S.C. § 371 based on International Application No. PCT/EP2019/066953, filed Jun. 26, 2019, which was published under PCT Article 21(2) and which claims priority to German Application No. 10 2018 210 496.4, filed Jun. 27, 2018, which are all hereby incorporated in their entirety by reference.

TECHNICAL FIELD

Exemplary embodiments concern a method for a dishwasher and a device for use in a dishwasher, in particular for monitoring a condition of a cleaning program carried out by the dishwasher.

BACKGROUND

Methods for operating or controlling household appliances, such as dishwashers are known from the state of the art. The aim of operating such household appliances is typically to achieve a high degree of user-friendliness and at the same time the best possible result (in the case of a dishwasher, in particular, a cleaning result that is as flawless as possible).

At least partially self-sufficiently working dosing devices are known, which may, for example, be placed in a treatment chamber of a dishwasher and may dispense a plurality of different preparations into the rinsing process of the dishwasher.

The use of such self-sufficiently operating dosing devices has, in particular, improved user-friendliness. Such dosing devices typically work with temperature and/or conductivity sensors in combination. Conductivity sensors or resistance sensors in particular depend on the fact that the liquid to be tested is forced to bypass the sensor so that the corresponding sensor may be in contact with the liquid. Furthermore, such sensors are subject to constant chemical and physical stress, as they are exposed to the cleaning process. In particular, chemicals in the wash liquor may change and damage the contacts of the sensors, as the sensors may be covered with substances, polarization may occur, which may lead to distorted measured values, and/or dirt deposits from the wash liquor may render the sensors unusable, especially if the sensors are installed in low-flow installation situations inside the dishwasher's treatment chamber for the reasons mentioned above.

The disadvantage is that, for example, temperature sensors for controlling such a dosing device cannot ensure that a cleaning program is completely monitored, since, for example, dishes in the rinse cycle no longer need to be heated during a so-called zeolite-active drying process. A temperature sensor used to identify the rinse cycle will therefore no longer be able to detect the drying process in the above example This may result in non-optimal control and/or regulation of the dosing device. Furthermore, a cleaning program regularly ends after the rinse phase, so that even the end of a cleaning program cannot be reliably detected. Furthermore, in the drying phase, for example, there is no more water circulation within the dishwasher's treatment chamber, so that even a conductivity sensor cannot provide corresponding results.

It would be desirable for an autonomous, automatic dosing device to inform the consumer about the condition or program status of a cleaning program, in particular whether a cleaning program has been completed.

SUMMARY

Methods, devices, and systems for monitoring a washing program of a dishwasher machine are provided herein. In an embodiment, a method includes detecting at least one set of acceleration data indicative of a progression of measured acceleration values, wherein the at least one set of acceleration data is detected by at least one acceleration sensor in a treatment chamber of the dishwasher. Status data indicative of a process step within a cleaning program performed by the dishwasher is then determined, wherein the status data is determined based on the at least one acceleration data. The determined status data is outputted or caused to be outputted.

BRIEF DESCRIPTION OF THE DRAWINGS

The present disclosure will hereinafter be described in conjunction with the following drawing figures, wherein like numerals denote like elements, and.

DETAILED DESCRIPTION

Figure 1:
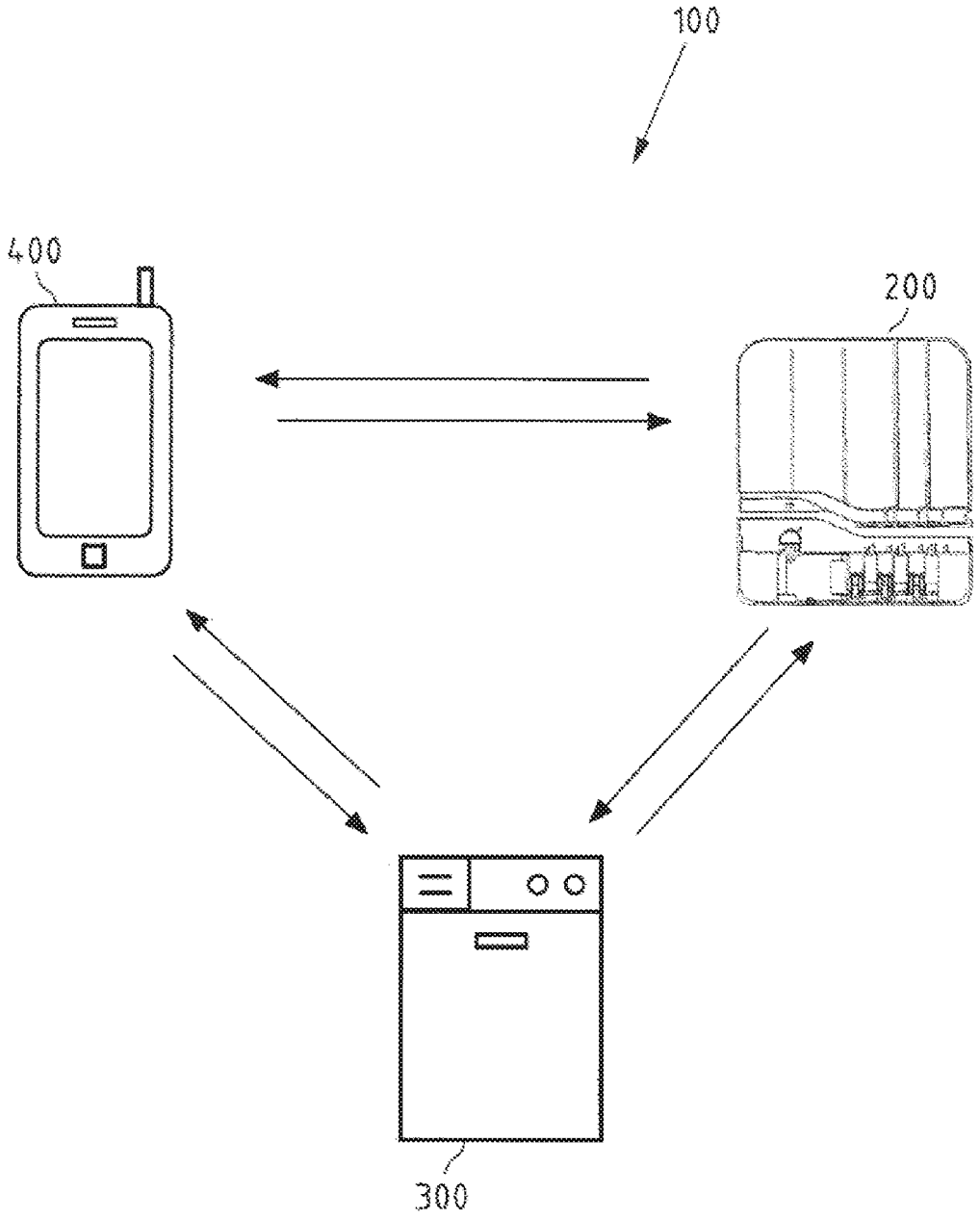
FIG. 1 shows a schematic representation of an embodiment of a system as contemplated herein.

The following detailed description is merely exemplary in nature and is not intended to limit the disclosure or the application and uses of the subject matter as described herein. Furthermore, there is no intention to be bound by any theory presented in the preceding background or the following detailed description.

The present disclosure concerns a method according to the subject-matter of the independent claim 1. Further embodiments are described in the dependent Claims.

According to a first exemplary aspect of the present disclosure, a method is disclosed which comprises the following:

acquiring of at least one set of acceleration data indicative of a progression of measured acceleration values, wherein the at least one set of acceleration data is acquired by at least one acceleration sensor in a treatment chamber of a dishwasher;

determining a set of status data indicative of a process step within a cleaning program performed by a dishwasher, wherein the status data is determined based on the at least one set of acceleration data; and outputting or causing the output of the particular status data.

According to a second aspect of the present disclosure, a device is described which is configured or includes appropriate features to perform and/or control a method according to the first aspect. Devices of the method according to the first aspect are or comprise in particular one or more devices according to the second aspect.

Alternatively or additionally, the device according to the second aspect may further comprise one or more sensors and/or one or more communication interfaces.

A communication interface is to be understood, for example, as a wireless communication interface and/or a wired communication interface.

A wireless communication interface is, for example, a communication interface according to a wireless communication technology. An example of a wireless communication technology is a local radio network technology such as Radio Frequency Identification (RFID) and/or Near Field Communication (NFC) and/or Bluetooth (e.g. Bluetooth version 2.1 and/or 4.0) and/or Wireless Local Area Network (WLAN). RFID and NFC, for example, are specified according to ISO standards 18000, 11784/11785 and ISO/IEC standards 14443-A and 15693. WLAN, for example, is specified in the standards of the IEEE 802.11 family Another example of a wireless communication technology is a supra-local radio network technology such as a mobile radio technology, for example Global System for Mobile Communications (GSM) and/or Universal Mobile Telecommunications System (UMTS) and/or Long Term Evolution (LTE). The GSM, UMTS and LTE specifications are maintained and developed by the 3rd Generation Partnership Project (3GPP).

A wired communication interface is, for example, a communication interface according to a wired communication technology. Examples of a wired communication technology are a Local Area Network (LAN) and/or a bus system, for example a Controller Area Network bus (CAN bus) and/or a Universal Serial Bus (USB). CAN bus, for example, is specified according to ISO standard ISO 11898. LAN, for example, is specified in the standards of the IEEE 802.3 family It is understood that the output module and/or the sensor module may also include other features not listed.

According to the second aspect of the present disclosure, an alternative device is also described, comprising at least one processor and at least one memory containing computer program code, wherein the at least one memory and the computer program code are adapted to execute and/or control with the at least one processor at least one method according to the first aspect. A processor is to be understood, for example, as a control unit, a microprocessor, a micro-control unit such as a micro-controller, a Digital Signal Processor (DSP), an Application-Specific Integrated Circuit (ASIC) or a Field Programmable Gate Array (FPGA).

An exemplary device, for example, further comprises features for storing data such as a program memory and/or a working memory. For example, an exemplary device as contemplated herein further comprises features for receiving and/or sending data via a network such as a network interface. Exemplary devices as contemplated herein are, for example, interconnected and/or connectable via one or more networks.

An exemplary device according to the second aspect is or comprises, for example, a data processing system which is configured in terms of software and/or hardware to be able to carry out the respective steps of an exemplary method according to the first aspect. Examples of data processing equipment are a computer, a desktop computer, a server, a thin client and/or a portable computer (mobile device), such as a laptop computer, a tablet computer, a wearable, a personal digital assistant or a smartphone.

Individual method steps of the method according to the first aspect may be performed with a sensor device, which also includes at least one sensor element or sensor(s). Likewise, individual method steps which, for example, do not necessarily have to be performed with the sensor device may be performed by a further device which is connected, in particular via a communication system, to the device which includes at least one sensor element or sensor(s).

Further devices may be envisaged, for example a server and/or, for example, a part or a component of a so-called computer cloud, which provides data processing resources dynamically for different users in a communication system. In particular, a computer cloud is understood to be a data processing infrastructure according to the definition of the "National Institute for Standards and Technology" (NIST) for the term "cloud computing". An example of a computer cloud is a Microsoft Windows Azure platform.

According to the second aspect of the present disclosure, a computer program is also described which comprises program instructions which cause a processor to execute and/or control a method according to the first aspect when the computer program is executed on the processor. An exemplary program as contemplated herein may be stored in or on a computer-readable storage medium containing one or more programs.

According to the second aspect of the present disclosure, a computer-readable storage medium containing a computer program according to the second aspect is also described. A computer-readable storage medium may, for example, be a magnetic, electrical, electro-magnetic, optical and/or other type of storage medium. Such a computer-readable storage medium is preferably physical (i.e. "touchable"), for example, it is designed as a data storage media device. Such data storage media device is for example portable or permanently installed in a device. Examples of such data storage media device are volatile or non-volatile memories with random access (RAM) like NOR flash memory or with sequential access like NAND flash memory and/or memory with read-only access (ROM) or read-write access. Computer-readable is to be understood, for example, as meaning that the storage medium may be read and/or written by a computer or a data processing system, for example by a processor.

According to a third aspect of the present disclosure, a system is also described comprising one or more devices which together perform a method according to the first aspect.

Exemplary features and exemplary embodiments according to all aspects are described in more detail below:

The progression of measured acceleration values is represented, for example, by a large number of measured acceleration values that were acquired over a predetermined period of time, whereby the respective absolute measured acceleration values are mapped to represent the progression over a time axis.

Dishwashers usually use a cleaning agent (e.g. so-called dishwasher tabs and/or rinse aid) to clean objects placed in the treatment chamber, such as cutlery, dishes, pans or pots, to name but a few non-limiting examples.

According to a design of the method according to the first aspect, the at least one device performing the method comprises or is the dishwasher and/or a separate device, in particular a mobile device (e.g. a dosing device), which may preferably be placed in the treatment chamber of the dishwasher.

For example, the device performing the method is or comprises the household device, i.e. in particular the dishwasher. If the dishwasher itself is trained for this purpose, the method may be performed with a small number of devices and in particular without an additional separate device of the user.

Alternatively, however, an additional and separate device to the dishwasher is provided. This has the advantage that the method may usually be performed independently of the type and properties of the dishwasher, which otherwise might not be possible or not to the same extent. The separate device is for example a mobile (portable) device. For example, the separate device is a mobile device that may optionally be in communication with the dishwasher (e.g. via a wireless network).

However, the separate device may also be a mobile device, which may in particular (during operation) be placed in the dishwasher, i.e. in the example of a dishwasher it may be placed in the interior or treatment chamber. Such a separate device is, for example, a dosing device, which is designed to deliver a substance (in particular a cleaning agent) to the dishwasher or into the treatment chamber of the dishwasher. Such a separate device may be in communication with the dishwasher, a mobile device and/or a remote server (e.g. to exchange the acquired data (e.g. acceleration data and sensor data)). Such a dosing device comprises for example the at least one acceleration sensor. Furthermore, such a dosing device comprises for example at least one further sensor configured to detect the at least one set of sensor data.

A casing surrounding the device is designed, for example, to be placed in the treatment chamber of the dishwasher and has, in particular, an appropriate size that allows the casing or device to be at least partially removed from the treatment chamber. In particular, the casing or device may be placed in the treatment chamber loosely and/or without connecting features. For example, in the case of a dishwasher, the casing or device must be placed in and/or removed from, together with the objects to be cleaned, the treatment chamber. In particular, the casing of the device partially or completely encloses some or all of the device's components. In particular, the casing is designed to be watertight so that some or all of the device's cleaning agents do not come into contact with water when the device is placed in a treatment chamber, for example a dishwasher's treatment chamber, and especially during treatment.

The device or casing referred to in the second aspect is in particular a mobile and/or portable device and/or a device other than a dishwasher. A mobile and/or portable device is to be understood, for example, a device whose external dimensions are smaller than about 30 cm×30 cm×30 cm, preferably smaller than about 15 cm×15 cm×15 cm. A device other than a dishwasher is, for example, a device that has no functional connection with the dishwasher and/or is not a part that is permanently connected to the dishwasher. For example, a device that is mobile and/or portable and different from the dishwasher is a device that is placed (e.g. inserted) in the dishwasher's treatment chamber by a user for the duration of a treatment process (e.g. cleaning program). An example of such a mobile and/or portable device as well as a device different from a dishwasher is the dosing device, which is placed or inserted in the treatment chamber of the dishwasher before the start of the cleaning program.

The casing may have at least one output module which is designed to dispense at least one preparation into the treatment chamber of the dishwasher and/or to trigger an output. The output of a preparation, for example, comprising cleaning agents, is to be understood, for example, as meaning that the preparation is output to the environment of the dosing device and/or a storage container for the preparation, for example, enclosed by the dosing device. The output is carried out, for example, by a respective output module. Alternatively or additionally, output may be affected by the output module, e.g. the output module causes the preparation to be output through the storage container. For example, the output module causes the preparation to be output through an output opening of the output module, the dosing device and/or the storage container to the environment of the output module and/or the storage container.

The casing further comprises, for example, at least one sensor module which is configured to acquire the at least one set of acceleration data and optionally the at least one set of sensor data. Such sensor data may, for example, be at least one parameter of a conductivity (for example of a substance located in the treatment chamber such as water and/or a cleaning solution or liquor) and/or the temperature, for example the temperature in the treatment chamber and/or the temperature of a substance located in the treatment chamber such as water, and/or the brightness (e.g., the temperature of the water and/or the brightness of the cleaning solution or liquor) (e.g. whether or not light enters the dishwasher treatment chamber), and/or time (e.g. the time elapsed from a particular event in the cleaning program (e.g. start, water change, drying process, to name but a few non-limiting examples). Accordingly, the sensor module may include one or more sensors that are designed to acquire at least one set of sensor data, such as a conductivity sensor and/or a temperature sensor (e.g. a thermocouple) and/or a timer.

An acceleration sensor (or accelerometer) is a sensor that measures its or an acceleration. This is done, for example, by determining the inertial force acting on a mass of the acceleration sensor. Thus it may be determined, for example, whether there is an increase or decrease in speed. Furthermore, the acceleration sensor may, for example, be included in the previously mentioned sensor module.

For example, an acceleration sensor may represent a motion sensor. Such a motion sensor may, for example, detect a change in position. A movement may, for example, be detected by employing an acceleration sensor in such a way that movements are calculated as an integration of detected data (e.g. measured values, e.g. the at least one set of acceleration data) from an acceleration sensor. For example, the dishwasher may determine the position or the orientation of the device (e.g. the dosing device), for example in the treatment chamber.

The acceleration data acquired by the acceleration sensor represents, for example, an acceleration and/or movement of the device according to the second aspect, which comprises the at least one acceleration sensor. Furthermore, based on the acceleration data acquired by the acceleration sensor may, for example, a specific position and/or orientation of the at least one acceleration sensor inside the dishwasher may be determined.

The at least one acceleration sensor acquires the measured values representing the progression, for example at a predefined sampling rate and/or sampling frequency, e.g. from about 0.001 Hz to about 1 GHz, preferably from about 0.1 to about 25 MHz.

To operate the at least one acceleration sensor, a supply voltage of from about 1V to about 6V, preferably from about 2.5V to about 4.0V, is required with an energy source, depending on the type of acceleration sensor used. In particular, the acceleration sensor may be operated with a supply voltage of from about 1.9V to about 3.6V, so that self-sufficient use, e.g. with a battery as the energy source, is possible.

An acceleration sensor that also has a high temperature tolerance is particularly suitable. This is understood to mean in particular error-free operation of the acceleration sensor at high ambient temperatures (e.g. above about 60° C.-65° C., about 70° C.-75° C., about 80° C.-85° C., about 90° C.-95° C., or above).

Furthermore, such an acceleration sensor has, for example, a sensitivity (resolution) that is in the range of detectable accelerations of ±8 g, ±7 g, ±6 g, ±5 g, ±4 g, ±3 g, ±2 g, ±1 g or below. As contemplated herein, acceleration sensors with a detectable range of ±2, ±1 g or below are particularly suitable, in particular due to the sometimes small deflections or accelerations which are detected during the execution of the method according to the first aspect of the present disclosure by employing an acceleration sensor.

For example, the at least one acceleration sensor has a resolution (also referred to as sensitivity) per LSB (Least Significant Bit) of from about 0.001 to about 10 milli g (gravities) per LSB, preferably of from about 0.05 to about 0.25 milli g per LSB.

The resolution of milli g per LSB represents a factor (sensitivity) with which unprocessed measured values acquired by the at least one acceleration sensor are multiplied to represent the resolution provided by the at least one acceleration sensor as a measured value. In this way, for example, acceleration data may be determined with the at least one acceleration sensor, which represents an acceleration of from 0 g to about 1000 g, preferably of from about 0.000 1g to about 16 g.

For example, a sensitivity (resolution) of the acceleration sensor may be achieved by using an analog-to-digital (A/D) converter, e.g. with a resolution of about 16, about 20, or about 24 bits, of about 0.06 milli g.

The at least one acceleration sensor has, for example, a sensitivity of from about 0.001 milli g per LSB (Least Significant Bit) to about 1.0 milli g per LSB, preferably of from about 0.05 milli g per LSB to about 0.25 milli g per LSB.

For example, the acceleration sensor is a MEMS (Micro Electro-Mechanical System) multi-axis acceleration sensor. Typically, such a MEMS sensor measures a change in capacitance when acceleration value changes.

The determination of the status data indicative of a process step within a cleaning program performed by a dishwasher is based at least partially on at least one set of acceleration data.

The determination of the status data at least partially based on the at least one set of acceleration data makes it possible to determine unambiguously that process step which, for example, is currently being performed by the dishwasher within the context of a cleaning program. Further details of the individual determinable process steps of a cleaning program and their exact determination at least partially based on the at least one set of acceleration data are explained in more detail in the following description.

An embodiment according to all aspects of the present disclosure stipulates that the orientation and/or the placement of the acceleration sensor inside the treatment chamber of the dishwasher are predefined.

An embodiment according to all aspects of the present disclosure stipulates, that the acceleration data is acquired with respect to the predefined orientation and/or placing of the at least one acceleration sensor in the treatment chamber of the dishwasher.

This is the case, for example, if the acceleration sensor does not change its orientation and/or placing with respect to the treatment chamber of the dishwasher during the execution of the method according to the first aspect of the present disclosure. For example, the device may also include features for determining the orientation and/or placing with respect to the dishwasher's treatment chamber. Alternatively, for example, the device according to the second aspect, which is configured to execute the method according to the first aspect, may comprise instructions (e.g. markings or the like, to give only one non-limiting example), so that, for example, a user may place the device according to the second aspect of the present disclosure in the treatment chamber of the dishwasher in such a way that the orientation and/or placing of the at least one acceleration sensor with respect to the treatment chamber of the dishwasher is predefined.

For example, if the acceleration sensor is not predefined in its orientation and/or placement inside the dishwasher's treatment chamber, its orientation and/or placement may be determined (e.g. estimated) at least in part based on the at least one set of acceleration data acquired. The method according to the first aspect is thus feasible, for example, independently of the orientation and/or placement inside the dishwasher's treatment chamber of the at least one acceleration sensor. In the case that the acceleration sensor is not predefined in its orientation and/or placement inside the treatment chamber of the dishwasher, a recommendation for an exemplary, in particular advantageous orientation and/or placement of the at least one acceleration sensor inside the treatment chamber of the dishwasher may be given to the user.

In an embodiment according to all aspects of the present disclosure is further included:

acquiring of at least one set of sensor data indicative of a progression of a temperature and/or a time, wherein the status data is further determined based on the at least one set of sensor data.

The determination of the status data indicative of a process step within a cleaning program performed by a dishwasher is based at least partially on the at least one set of acceleration data and the at least one set of sensor data.

Accordingly, both the acceleration data and the sensor data indicative of, for example, a temperature and/or time are taken into account to determine the status data.

Determining the status data at least partially based on the at least one set of acceleration data and the at least one set of sensor data enables a clear determination of the process step that is currently being performed by the dishwasher, for example, as part of a cleaning program.

An embodiment according to all aspects of the present disclosure stipulates that at least one set of sensor data is acquired by a temperature sensor and/or a timer.

The at least one set of sensor data represents, for example, a temperature, a time, a brightness or a light intensity, or a combination thereof. At least one temperature sensor, for example, may be used to detect the at least one set of sensor data indicative of a temperature. For the acquisition of the at least one set of sensor data indicative of a time, for example, at least one timer may be used. For example, at least one brightness sensor or light intensity sensor may be used to acquire sensor data indicative of brightness. One or more (e.g. all) of these aforementioned sensors (e.g. the temperature sensor and/or the timer) may, for example, be included in the device according to the second aspect of the present disclosure, or alternatively or additionally be operatively (e.g. electrically) connectable to it.

The output or initiation of the output of the specific status data takes place. This can be done once, for example. Alternatively, if, for example, the at least one set of acceleration data is continuously acquired and/or the at least one set of sensor data is continuously acquired and the status data is then determined (at least based on the part of the acceleration data and/or the sensor data that has been added (i.e. newly acquired) and for which no status data has yet been determined), the output or initiation of the output of the status data may be performed several times. The output may, for example, be to the dishwasher in the case that the method according to the first aspect of the present disclosure is carried out by a device separate from the dishwasher (a device according to the second aspect of the present disclosure, e.g. the dosing device). Alternatively or additionally, the output or causing of the output may, for example, be made to a device that is different from the dishwasher or from the separate device, for example to a server. The server may, for example, provide so-called cloud services, for example such a server may determine control data for the device according to the second aspect of the present disclosure, just to give one non-limiting example.

In an embodiment according to all aspects of the present disclosure, the method further comprises:

determining control data at least partially based on status data, wherein the control data causes a dosing device to perform a dosing of cleaning and/or care agent defined according to the control data.

The dosing device is, for example, the device according to the second aspect of the present disclosure.

Based on the control data, the dosing device is controlled and/or regulated. The dosing device may, for example, be a self-contained or built-in dosing device. Furthermore, the dosing device may be, for example, part of the device according to the second aspect of the present disclosure, or may be included in the device according to the second aspect of the present disclosure. In this case, the device according to the second aspect of the present disclosure and the dosing device form a single entity. The dosing device is alternatively a device separate from the device according to the second aspect of the present disclosure, for example, the mobile device described above. For example, the dosing device may at least partially automatically execute and/or control the method according to the first aspect of the present disclosure, e.g. automatically after a prior input by a user to switch on the dosing device.

The control data may also initiate or cause the operation or control of a dishwasher at least in respect of the specific status data. Such operation or control may, for example, include selecting or changing a cleaning program of the dishwasher, changing one or more process parameters of a cleaning program carried out by the dishwasher and/or adding or omitting method sections of the cleaning program.

It goes without saying that the control data may also initiate or cause the operation or control of the dosing device, at least taking into account the specific status data. In this case, the control data may be determined by the dishwasher, for example, so that the dishwasher enables operation or control of the dosing device. The control data may, for example, be determined by a server (or a server cloud) and then output (e.g. transmitted) to the dishwasher and/or the dosing device for operating or controlling operation. For this purpose, the dishwasher and/or the dosing device may, for example, have an API (Application Programming Interface) so that the operation or control of the dishwasher and/or the dosing device is enabled by the server (or server cloud).

According to a further embodiment of the method according to the first aspect, the control data also influences:

switching the dishwasher on and/or off;

selecting, combining and/or dosing a detergent to be used for the dishwasher; and/or a cleaning program of the dishwasher.

With regard to switching the dishwasher on and/or off, it may be influenced, for example, whether the dishwasher is switched on and/or off (at all) and/or at what time (time, date) the dishwasher is switched on and/or off, just to name a few non-limiting examples.

Influencing the selection, composition and/or dosing of a detergent to be used for the dishwasher may be affected by different actions. For example, the quantity to be dosed (e.g. the quantity of detergent and/or rinse aid), the dosing time, the product to be dosed or individual ingredients or combinations thereof may be influenced. A dosing device and/or a dispensing module, which may be included in the device according to the second aspect of the present disclosure, may perform a corresponding dosing of the detergent.

The control data may, for example, cause a dispensing and/or triggering of the output of a preparation on the part of the dosing device and/or the output module which is included or connectable to the device according to the second aspect of the present disclosure. For example, the control data was determined in such a way that, for example, the start of the cleaning program was acquired, so that, for example, cleaning may be carried out by a corresponding cleaning program of the dishwasher.

Influencing the cleaning program of the dishwasher may, for example, include selecting a certain (preprogrammed) program, running additional programs, influencing (lengthening or shortening) the program duration, changing individual parameters of the program (e.g. temperature, drying time, to name but a few non-limiting examples).

In addition, it is possible not only to operate or control the operation of the dishwasher (automatically) based on the control data, but also to make a recommendation to the user. For example, in addition to an automated adjustment of the dishwasher, it may also be possible to display a recommendation to the user, e.g. by employing an output device of a user interface (e.g. included in the dishwasher). For example, the user may be informed that e.g. intensive cleaning by employing an appropriate cleaning program will extend the duration of the cleaning program.

An embodiment according to all aspects of the present disclosure stipulates that the device according to the second aspect is designed to communicate with the dishwasher, in particular to communicate wirelessly with the dishwasher.

For example, communication with the dishwasher may be affected by employing a communication interface contained in the device according to the second aspect of the present disclosure. The communication interface is especially designed to communicate wirelessly with the dishwasher.

An embodiment according to all aspects of the present disclosure stipulates that the status data represents one or more process steps i) to xi) of the cleaning program:

i) start of the cleaning program;
ii) performing filling with water during the cleaning program;
iii) performing a water change during the cleaning program;
(iv) performing a pre-rinse cycle during the cleaning program;
(v) performing a main cleaning cycle during the cleaning program;
(vi) performing a first rinse, in particular an intermediate rinse, during the cleaning program;
vii) performing further rinsing steps, in particular further intermediate rinsing runs, during the cleaning program;
viii) performing a final rinse (rinse cycle) during the cleaning program;
ix) performing a drying process during the cleaning program;
x) performing an alternative (e.g. zeolite-active) drying process during the cleaning program; and
(xi) end of the cleaning program.

In an embodiment based on all aspects of the present disclosure, the determination of the status data is further based on one or more of the following steps a noise level represented by the at least one set of acceleration data at two acquisition times;
a variation represented by the at least one set of acceleration data compared with a variation represented by the temperature of the sensor data; and
a progression represented by at least one set of acceleration data compared with a progression represented by the time of the sensor data.

The status data represents, for example, process step i) in that a noise level represented by the at least one set of acceleration data is compared with one another at two acquisition times. For example, a silent noise level is compared to an active noise level, e.g. by determining variances of the corresponding levels. This corresponds with the start of the cleaning program. Furthermore, an active noise level is compared, for example, with a current noise level. This corresponds, for example, with stopping the spray arm rotation, which identifies the start of a drying process.

By comparing the silent noise level with a current level, it is therefore possible to clearly determine whether a cleaning program has been started or not.

The status data represents, for example, process step ii) by comparing a progression represented by at least one set of acceleration data with a progression represented by a temperature of the sensor data.

It is therefore possible to unambiguously determine a water change by identifying a pumping process and/or a possibly subsequent rest period based on acceleration data acquired by an acceleration sensor and/or sensor data acquired by a temperature sensor indicative of a temperature profile (alternatively: temperature data).

It is therefore also possible to determine whether the spray arm movement has ended or not by comparing an active level with a current level. Furthermore, by combining the acceleration data with a time measurement, it is therefore possible to clearly identify the drying process (process step ii)), which is carried out as part of a dishwasher's cleaning program.

The status data represents, for example, process step iii) by comparing a progression represented by the at least one set of acceleration data with sensor data indicative of a temperature progression, which is detected by a temperature sensor.

It is therefore possible to identify zeolite-active rinsing cycles in the drying process of a cleaning program carried out by a dishwasher by a combination of acquired acceleration data and temperature data.

The status data represents, for example, process step iv) by comparing a progression represented by the at least one set of acceleration data with a progression represented by the time of the sensor data.

It is therefore possible by a combination of acceleration data and acquired time measurement values, e.g. time data acquired with a timer, to identify the end of a cleaning program by the acceleration data and time data acquired during a drying process of the cleaning program.

An embodiment according to all aspects of the present disclosure stipulates that the at least one set of acceleration data and the at least one set of sensor data are acquired in parallel.

The acquisition of the at least one set of acceleration data simultaneously with the acquisition of the at least one set of sensor data enables, for example, the use of the at least one set of acceleration data and the at least one set of sensor data to determine the status data which then represents at least one of the process steps i) to xi) of the cleaning program.

An embodiment according to all aspects of the present disclosure stipulates that the acceleration data and/or the at least one set of sensor data are each acquired over a predefined period of time.

The predefined time span is indicative of a continuous discrete acquisition of the acceleration data and at least one set of sensor data. The predefined time span may be defined, for example, by a certain time period, e.g. for a duration of a few minutes, up to several days or weeks, to name just a few non-limiting examples. The acquisition of the acceleration data and of the at least one set of sensor data may trigger the acquisition for a then to be determined or predetermined period of time. For example, if the device (e.g. the dosing device) is switched on according to the second aspect of the present disclosure, an acquisition of the acceleration data and of the at least one set of sensor data may take place for a period of from about 1 to about 10, from about 2 to about 8, from about 3 to about 7, from about 4 to about 6 or about 5 minutes, since it is to be assumed, for example, that after the dosing device has been switched on, for example by the user, a cleaning program is carried out by employing the dishwasher.

An embodiment according to all aspects of the present disclosure stipulates that the at least one acceleration sensor is placed inside the treatment chamber of the dishwasher, in particular on or in a lower basket for receiving objects to be cleaned, so that the predefined placing of the at least one acceleration sensor is inside the treatment chamber of the dishwasher.

Correspondingly, the acceleration data then acquired represents a movement and/or acceleration of the at least one acceleration sensor in relation to the lower basket.

The status data is determined, for example, in dependence on a predefined orientation and/or placing of the at least one acceleration sensor. For example, amplitudes of the measured acceleration values represented by the at least one set of acceleration data may be related to the knowledge of the placement of the at least one acceleration sensor within the treatment chamber of the dishwasher. For example, an active level noise (e.g. represented by an oscillation of the at least one acceleration data) may change in its amplitude depending on whether the at least one acceleration sensor is located e.g. in the lower basket or in the middle basket or in a cutlery drawer of the treatment chamber of the dishwasher.

An embodiment according to all aspects of the present disclosure stipulates that the at least one set of acceleration data represents a signal in the direction of each of two or three degrees of freedom.

A movement of the at least one acceleration sensor is exemplified, for example, by a movement of the at least one acceleration sensor comprising one or more degrees of freedom, by a movement path, or a combination thereof. For example, the one or more degrees of freedom and/or the movement path may be used to represent a distance covered by the at least one acceleration sensor. For example, the further the distance traveled, the stronger the amplitude represented by the at least one set of acceleration data. For example, the at least one acceleration sensor may detect acceleration data in a direction of one of the two or three degrees of freedom. In the event that acceleration data is acquired in a direction of each of three degrees of freedom, the at least one acceleration sensor, for example, acquires acceleration data in x-axis direction (e.g. the axis between the back wall and the door of the treatment chamber), in y-axis direction (e.g. the axis between the top and the bottom of the treatment chamber), and in z-axis direction (e.g. the axis between the side walls of the treatment chamber).

In a further embodiment according to all aspects of the present disclosure, the acceleration data is at least partially indicative of a movement of the at least one acceleration sensor with respect to its orientation and/or placement in the treatment chamber of the dishwasher.

An embodiment according to all aspects of the present disclosure stipulates that the determination of the status data is carried out separately for every two or three degrees of freedom.

The at least one set of acceleration data is acquired (e.g. measured) by the at least one acceleration sensor, for example, in the direction of 2-axes (x-, y-axes) or 3-axes (x-, y-, z-axes) with respect to a Cartesian coordinate system. The respective axes are perpendicular to each other, so that two or three (all) spatial directions may be detected.

Furthermore, the acquired acceleration data represents, whether the acceleration is positive or negative.

An embodiment according to all aspects of the present disclosure stipulates that the determination of the status data is carried out separately for all two or three degrees of freedom.

The respective acceleration data, acquired in one of the two or three directions of the degrees of freedom may, for example, be compared with each other in the course of determining the status data. Alternatively or additionally, the status data may be determined for each acceleration data in one direction of the two or three degrees of freedom.

If the at least one set of acceleration data represents acceleration data in the direction of each of three degrees of freedom, the individual acceleration data of each direction may, for example, be compared with each other. In this way it is possible, for example, that recognized characteristic patterns, which are derived from acceleration data in one direction (e.g. x-direction, or along the x-axis of the coordinate system), are compared with a signal in a further direction (e.g. y- or z-direction, or along the y- or z-axis of the coordinate system) to verify the characteristic pattern which can be determined in the course of determining the status data.

An embodiment according to all aspects of the present disclosure stipulates that the predefined orientation and/or the predefined placement of the at least one acceleration sensor in the treatment chamber of the dishwasher is determined based on a comparison between the signals in the direction of all degrees of freedom represented by the at least one set of acceleration data.

The orientation and/or the placement of the acceleration sensor inside the treatment chamber of the dishwasher are predefined. Based on the acquired at least one set of acceleration data, for example, the predefined orientation and/or the predefined placement of the at least one acceleration sensor inside the treatment chamber of the dishwasher may be determined. For this purpose, the following may, for example, be performed:

As long as the rinse process of the cleaning program is active, the progression of the respective acceleration data oscillates on all axes (two or three degrees of freedom) with different amplitudes. The degree of amplitude depends on the placing of the at least one acceleration sensor (and optionally on the placing of the dosing device comprising the acceleration sensor). With a defined (i.e. fixed) position of the dosing device, this results in defined axis directions, which are acquired by the respective acceleration data. If stronger amplitudes are represented by the respective acceleration data on one of the axes compared to the other axes, it is the axis between the lid and the floor of the treatment chamber of the dishwasher, since the stronger amplitudes (e.g. oscillations) are caused by the impact of a spray jet from at least one spray arm on the side surfaces of the dosing device, which results in a movement of the acceleration sensor. This means that whenever stronger signals occur on the z-axis compared to the other axes, the at least one acceleration sensor (and thus optionally also the dosing device) is positioned parallel to the side wall. If the signal is strongest on the x-axis, the at least one acceleration sensor (and thus optionally also the dosing device) is positioned parallel to the dishwasher door. This means that the position of the at least one acceleration sensor (and thus optionally also the dosing device) in the dishwasher's treatment chamber may be clearly determined. This data can be used, for example, to provide the user with further information on the placement of the dosing device or, in the event of malfunctions that occur from time to time, to give advice on how to solve them.

In an embodiment according to all aspects of the present disclosure, the method further comprises:

generating user profile data at least partially based on the acquired one set of acceleration data and/or the at least one set of sensor data, wherein the status data is further determined based on the user profile data.

For example, status data may be determined for each or at least a plurality of cleaning programs performed by the dishwasher. For example, all acceleration data, sensor data, and the associated determined status data may be stored in a database. Optionally, these may be evaluated. The storage and/or evaluation may be performed locally by the device (e.g. the dosing device) according to the second aspect of the present disclosure. Alternatively, storage and/or evaluation may be performed by a remote system (e.g. server or server cloud). By employing the storage, a user profile may be generated, so that the acceleration data, sensor data, as well as the associated specific status data may be considered as historical values, for example, in a subsequent performance of the method according to the first aspect of the present disclosure.

The stored acceleration data, sensor data, and the corresponding specific status data may also be optionally fed to a machine learning tool, for example, to recognize data patterns. The data patterns may, for example, be used to give the user feedback on his app, to point out problems or to control a dosing device.

In a further exemplary embodiment according to all aspects of the present disclosure, the status data is determined by employing an artificial neural network.

For example, the at least one set of acceleration data and optionally the at least one set of sensor data may be communicated (e.g. transmitted) to a server which comprises or is connected to an artificial neural network. The determination of the status data may then be performed, for example, by employing the artificial neural network. The result may then be communicated to the device according to the second aspect of the present disclosure and/or the dishwasher.

The artificial neural network includes, for example, an evaluation algorithm, so that, for example, training cases may be learned from as examples and these may then be generalized as a basis for determining a result (the status data) after the learning phase has ended. This means that examples are not simply learned by heart, but patterns and regularities in the learning data are recognized. Different approaches may be followed for this purpose. For example, supervised learning, partially supervised learning, unsupervised learning, reinforced learning and/or active learning may be used. Supervised learning may, for example, be carried out using an artificial neural network (e.g. a recurrent neural network) or a support vector machine. Unsupervised learning may also be performed by employing an artificial neural network (e.g. an auto encoder). The learning data are, for example, several times acquired acceleration data and/or optional several times acquired sensor data and/or status data determined after a run through the artificial neural network.

It is also possible to use the repeated acquisition of the acceleration data and the sensor data and the status data for machine learning. For example, the user profile or one or more sets of data covered by the user profile may be determined at least partially based on machine learning.

By these measures the reliability of the determination of the status data of the dishwasher, and/or control and/or regulation of the device according to the second aspect of the present disclosure and/or the dishwasher and subsequently, in particular, the treatment of objects to be cleaned by the dishwasher, in particular, for the improved removal of soiling, may be increased.

Each of the training cases may, for example, be given by an input vector, a set of acceleration data and one set of sensor data and an output vector of the artificial neural network.

Each training case of the training cases may be generated, for example, by converting the control and/or regulation of the device belonging to the training case according to the second aspect of the present disclosure and/or the dishwasher, as well as determining the corresponding status data into a predetermined condition (e.g. defined performance of a cleaning process with prior knowledge of the parameters of the cleaning program, e.g. which process step is performed at which time within the scope of the defined cleaning program, to name only one non-limiting example), and representatively acquiring acceleration data and optional sensor data. The acceleration data and the optional sensor data then acquired are determined, for example, as input vector, and the (actual) process step of the dishwasher's cleaning program is determined as output vector of the training case as reference status data. Then the status data determined by the artificial neural network is transferred to that of the output vector. In this way, the artificial neural network may be trained iteratively or successively and the accuracy (e.g. hit rate) of the artificial neural network may be increased.

The artificial neural network may also be of the Generative Adversarial Network (GAN) type. Such a GAN comprises, for example, at least two artificial neural networks which compete against each other in such a way that their results are compared with each other. In this way, the quality of the result determined by the artificial neural network may be inferred. For example, a first artificial neural network of the GAN operates with data which it obtains, for example, from the current measurements (e.g. acquiring at least one set of acceleration data, and optionally acquiring at least one set of sensor data) and generates a statement (e.g. by employing a corresponding generator) about the result. In the present case, for example, the status data is determined. The second artificial neural network of the GAN (also called discriminator) may now compare this statement with an ideal, predetermined result or an ideal trained result. If the second artificial neural network determines no or only a small difference compared to the statement of the first artificial neural network, an optimal result is achieved. In this way, the determination of the status data by employing such a GAN artificial neural network may be significantly improved.

The exemplary embodiments of the present disclosure described above in this description should also be understood in all combinations with each other in a disclosed manner In particular, exemplary embodiments should be understood in terms of the different aspects disclosed.

In particular, the previous or following description of method steps according to preferred embodiments of a method should also reveal corresponding features for carrying out the method steps by preferred embodiments of a device. Likewise, by the disclosure of employing a device for performing a method step, the corresponding method step shall also be disclosed.

Further advantageous exemplary embodiments of the present disclosure are shown in the following detailed description of some exemplary embodiments of the present disclosure, especially in connection with the Figures. The Figures, however, are only intended to clarify, but not to determine the scope of protection of the present disclosure. The Figures are not to scale and are merely intended to illustrate the general concept of the present disclosure. In particular, features included in the Figures are not intended to be considered as a necessary element of the present disclosure.

FIG. 1 first shows a schematic representation of an exemplary embodiment of System 1 as contemplated herein, comprising devices 200, 300 and 400. System 1 is configured to execute exemplary methods as contemplated herein. Device 200 is an exemplary mobile device 200, which in this case may be placed in the treatment chamber of the dishwasher 300. Both the device 200 and the dishwasher 300 may each be a device as contemplated herein. Furthermore, System 1 comprises as a further device a mobile device 400 in the form of a smartphone. Mobile device 400 may also perform individual steps of exemplary methods as contemplated herein. However, device 400 may also be a computer, a desktop computer or a portable computer, such as a laptop computer, a tablet computer, a Personal Digital Assistant (PDA) or a wearable. In addition or alternatively to devices 300 and 400, the system may also include a server (not shown in FIG. 1). It is also conceivable that System 1 also includes fewer or more than three devices. Device 400 may also represent the server. In this case, device 400 is then operatively connected via a communication network (e.g. the Internet) to at least one of the devices 200 or 300.

Each of the devices 200, 300, 400 may feature a communication interface in order to communicate with one or more of the other devices or to transfer and/or to exchange data from one device to another.

Figure 3:
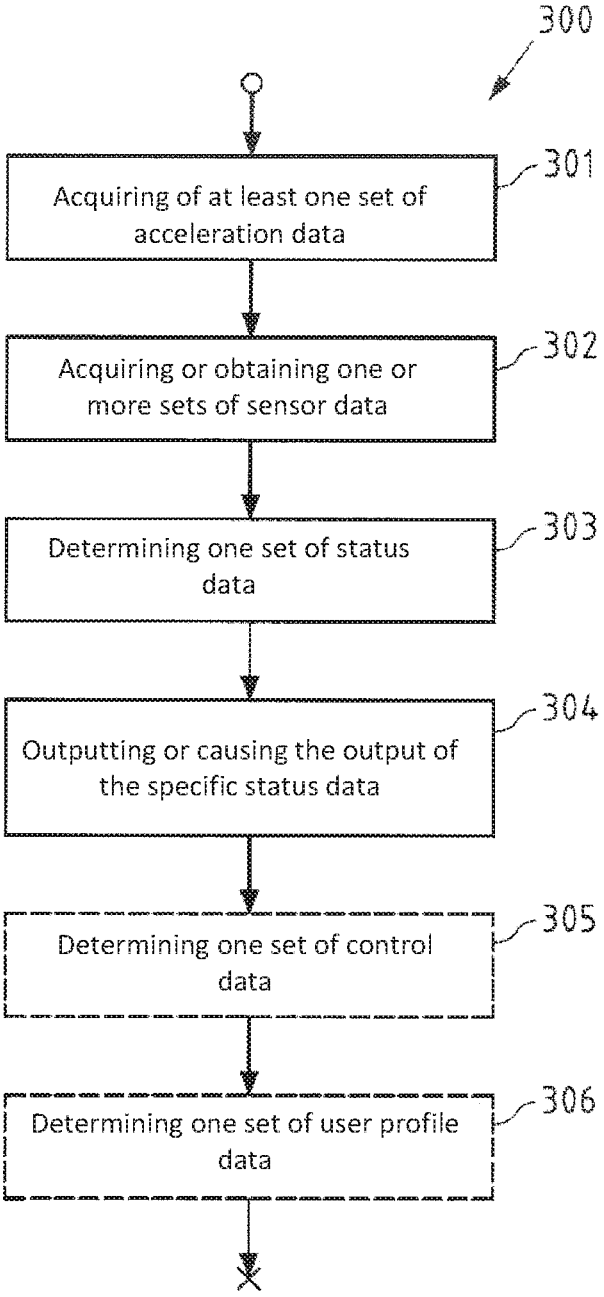
FIG. 3 shows a flow chart of an exemplary embodiment of a method as contemplated herein.

FIG. 3 shows a flowchart 30 of an exemplary embodiment of a method according to the first aspect of the present disclosure. Flowchart 30 may, for example, be executed by device 200 according to FIG. 1. Flowchart 30 may, for example, be executed by device 300 as shown in FIG. 1. Flowchart 30 may, for example, be executed both by device 200 according to FIG. 1 and by device 300 according to FIG. 1 together. Flowchart 30 may, for example, be executed by devices 200, 300 and 400 together as shown in FIG. 1.

In a first step 301, at least one set of acceleration data is acquired. Acquisition takes place, for example, by employing an acceleration sensor (e.g. acceleration sensor(s) 215 according to FIG. 2), which is integrated in device 200 or 300 according to FIG. 1. The acceleration sensor is situated in the treatment chamber of the dishwasher 300 during detection. In the event that device 200 according to FIG. 1 includes the acceleration sensor, it is thus at least temporarily located inside the treatment chamber of the dishwasher 300 during the acquisition.

In an optional second step, at least one set of sensor data is acquired. The acquisition is carried out, for example, by employing a sensor (e.g. a temperature sensor and/or a timer 216 according to FIG. 2), which is included in device 200 or 300 according to FIG. 1. The temperature sensor and/or the timer are located in the treatment chamber of the dishwasher 300 during the acquisition. In the case that device 200 according to FIG. 1 includes the temperature sensor and/or the timer these are thus at least temporarily located inside the treatment chamber of the dishwasher 300 during acquisition.

In a third step 303, at least one set of status data is determined. The determination of the status data may, for example, be carried out by the device which has also carried out steps 301 and 302. Alternatively, the determination of the status data of step 303 may be carried out by a device (e.g. device 400 according to FIG. 1) which is different from the device (e.g. device 200 according to FIG. 1) which has carried out steps 301 and 302.

In a fourth step 304, the status data determined in step 303 is output or caused to be output. For example, the status data is output to a device 200, 300 or 400. For example, if the status data is output to the dishwasher 300, the dishwasher 300 may, based on the status data, perform a cleaning of items, to give just one example. In case the status data is output to device 400 (e.g. mobile device of a user), the user of device 400 may be prompted to perform an action, e.g. to perform a predefined placement and/or orientation of device 200 according to FIG. 1 in the treatment chamber of dishwasher 300 according to FIG. 1.

In an optional fifth step 305, control data is determined based on the status data or on the status data output. This specific control data may then be output. If the status data was output to device 400 according to FIG. 1, or was determined by device 400 according to FIG. 1, this device 400 may also perform step 305. Afterwards, the specific control data may be output, for example, from device 400 to device 200 and/or 300 according to FIG. 1, so that device 200 and/or 300 according to FIG. 1 trigger an action corresponding to the control data, e.g. carrying out dosing or starting a cleaning program, to name just a few non-limiting examples. Alternatively, the status data determined by device 200 may be output to device 300 and/or 400 accordingly.

In an optional sixth step 306, a set of user profile data is created, for example based on the at least one set of acceleration data acquired in step 301, the at least one set of sensor data acquired in step 302, and the status data determined in step 303. The creation of the user profile data may be performed, for example, by the device that performed the steps 301 and 302 of the acquisition. Alternatively, the creation of the user profile data may be performed, for example, by the device that performed step 303 of determining the status data. These two devices mentioned above may be different from each other, e.g. steps 301 and 302 may be performed by device 200 or 300 according to FIG. 1, and step 303 may be performed by device 400 according to FIG. 1. Alternatively, all steps 301 to 303 may be performed by device 200 or 300 according to FIG. 1.

The step of acquiring the at least one set of acceleration data 301 and/or the step 302 of acquiring the at least one set of sensor data may be performed simultaneously with step 303. This means that, for example, after an initial execution of step 301 and step 302, step 303 for determining the status data is performed while step 301 and step 302 are further executed by acquiring further acceleration data (step 301) and sensor data (step 302). Subsequently, based at least partially on these further acceleration data (step 301) and sensor data (step 302) that have been acquired, step 303 or steps 303 to 304 and optionally steps 305 and/or 306 may, for example, be performed again.

Figure 2:
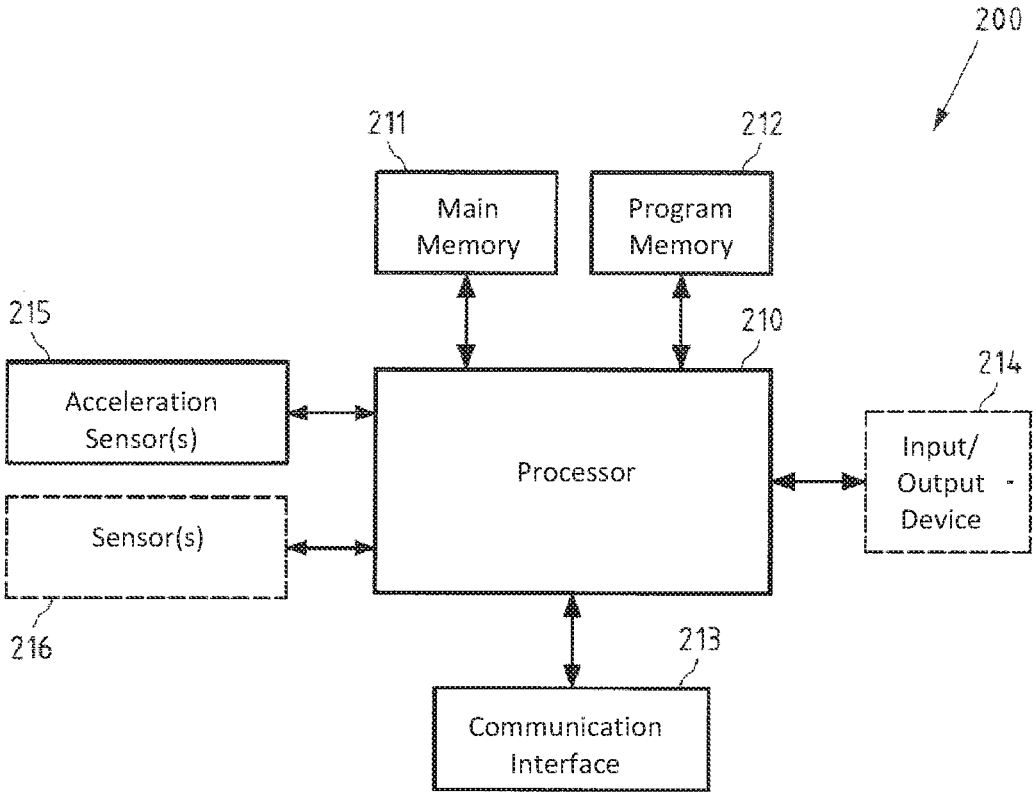
FIG. 2 shows a block diagram of an embodiment of a device as contemplated herein for carrying out an embodiment of a method as contemplated herein.

FIG. 2 now shows a block diagram 20 of an exemplary embodiment of a device according to the second aspect of the present disclosure for performing an exemplary embodiment of a method according to the first aspect of the present disclosure. Block diagram 20 according to FIG. 2 may be used as an example for device 200 shown in FIG. 1, dishwasher 300 shown or the mobile device 400 (or part of it) shown.

Processor 210 of device 20 is designed in particular as a microprocessor, micro-controller unit, micro-controller, Digital Signal Processor (DSP), Application-Specific Integrated Circuit (ASIC) or Field Programmable Gate Array (FPGA).

Processor 210 executes program instructions stored in program memory 212 and stores, for example, intermediate results or the like in the working or main memory 211. Program memory 212 is, for example, a non-volatile memory such as a flash memory, a magnetic memory, an EEPROM memory (Electrically Erasable Programmable Read-Only Memory) and/or an optical memory. Main memory 211 is, for example, a volatile or non-volatile memory, in particular a Random Access Memory (RAM) such as a Static RAM memory (SRAM), a Dynamic RAM memory (DRAM), a Ferroelectric RAM memory (FeRAM) and/or a Magnetic RAM memory (MRAM).

Program memory 212 is preferably a local data storage medium firmly connected to device 20. Data storage media permanently connected to device 20 is, for example, hard disks which are built into device 20. Alternatively, the data storage medium may, for example, also be a data storage medium that is detachably connectable to device 20.

Program memory 212 contains, for example, the operating system of device 20, which is at least partially loaded into main memory 211 when the device 20 is started and is executed by processor 210. In particular, when device 20 is started, at least part of the core of the operating system is loaded into main memory 211 and executed by processor 210.

In particular, the operating system allows the use of device 20 for data processing. For example, it manages resources such as main memory 211 and program memory 212, communication interface 213, optional input and output device 214, provides basic functions to other programs through programming interfaces and controls the execution of programs.

Processor 210 further controls communication interface 213, which may, for example, be a network interface and may be designed as a network card, network module and/or modem. Communication interface 213 is configured in particular to establish a connection of device 20 (e.g. at least one of the devices 200, 300, and/or 400 according to FIG. 1) with other devices, in particular via a (wireless) communication system, for example a network, and to communicate with them. Communication interface 213 may, for example, receive data (via the communication system) and forward it to processor 210 and/or receive data from processor 210 and send it (via the communication system). Examples of a communication system are a local area network (LAN), a wide area network (WAN), a wireless network (e.g. according to the IEEE 802.11 standard, the Bluetooth (LE) standard and/or the NFC standard), a wired network, a mobile network, a telephone network and/or the Internet. For example, communication is possible with the Internet and/or other devices using the communication interface 213. In the case of devices 200, 300, 400 according to FIG. 1, communication interface 213 may be used to communicate with the other devices 200, 300, 400 or the Internet.

Via such communication interface 213, in particular the at least one set of acceleration data (cf. step 301 according to FIG. 3), the at least one set of sensor data (cf. step 302 according to FIG. 3), and/or one set of status data (cf. step 303 or 304 according to FIG. 3) may be acquired (received) or output via these to a further device.

Furthermore, processor 210 may control at least one optional input/output device 214. Input/output device 214 is, for example, a keyboard, a mouse, a display unit, a microphone, a touch-sensitive display unit, a loudspeaker, a reader, a drive and/or a camera. For example, input/output device 214 may receive input from a user and forward it to processor 210 and/or receive and output data for the user from processor 210.

Finally, device 20 may comprise further components 215, 216.

Acceleration sensor(s) 215 may, for example, acquire one or more sets of acceleration data (cf. step 301 in FIG. 3).

Sensor(s) 216 are, for example, a temperature sensor to acquire temperature data from the at least one set of sensor data, and/or a timer to acquire time data from the at least one set of sensor data, and/or optionally a brightness sensor to acquire brightness data from the at least one set of sensor data. The temperature data, the time data and the brightness data may be included or represented by the at least one set of sensor data (cf. step 302 of FIG. 3).

The exemplary embodiments listed below should also be understood as disclosed:

The solution as contemplated herein makes it possible to describe a process and program sequence of a dishwasher unambiguously (i.e. precisely or exactly), both for dishwashers used in households and for commercial dishwashers.

For this purpose, for example, a dosing device may execute and/or control the method according to the first aspect of the present disclosure, which may be operated autonomously, and may deliver a plurality of different preparations into the washing process.

A device according to the second aspect of the present disclosure, e.g. a dosing device 200 according to FIG. 1, comprises at least one acceleration sensor which may be placed in the treatment chamber of a dishwasher. Such an acceleration sensor, e.g. mounted on an electronic board of the (self-contained) dosing device, is capable of fully detecting vibrations, shocks and/or mechanical events during a dishwashing process or cleaning program and making them accessible for interpretation. In combination with other sensors, such as a temperature sensor, the cleaning program may be described unambiguously. The data determined by the sensors may, for example, be supplied to applications for machine learning, whereby pattern analyses, for example, are then created and these may then be used to determine control data for controlling and/or regulating a device according to the second aspect of the present disclosure, e.g. a dosing device or a dishwasher.

The present disclosure provides the following advantages:

- full sensory description of a cleaning program performed by a dishwasher;
- unambiguous description of process events;
- machine-independent applicability;
- creation of washing profiles;
- application of machine learning and pattern recognition; and
- development of e.g. algorithms for control and/or regulation of a dosing device.

Figure 4:
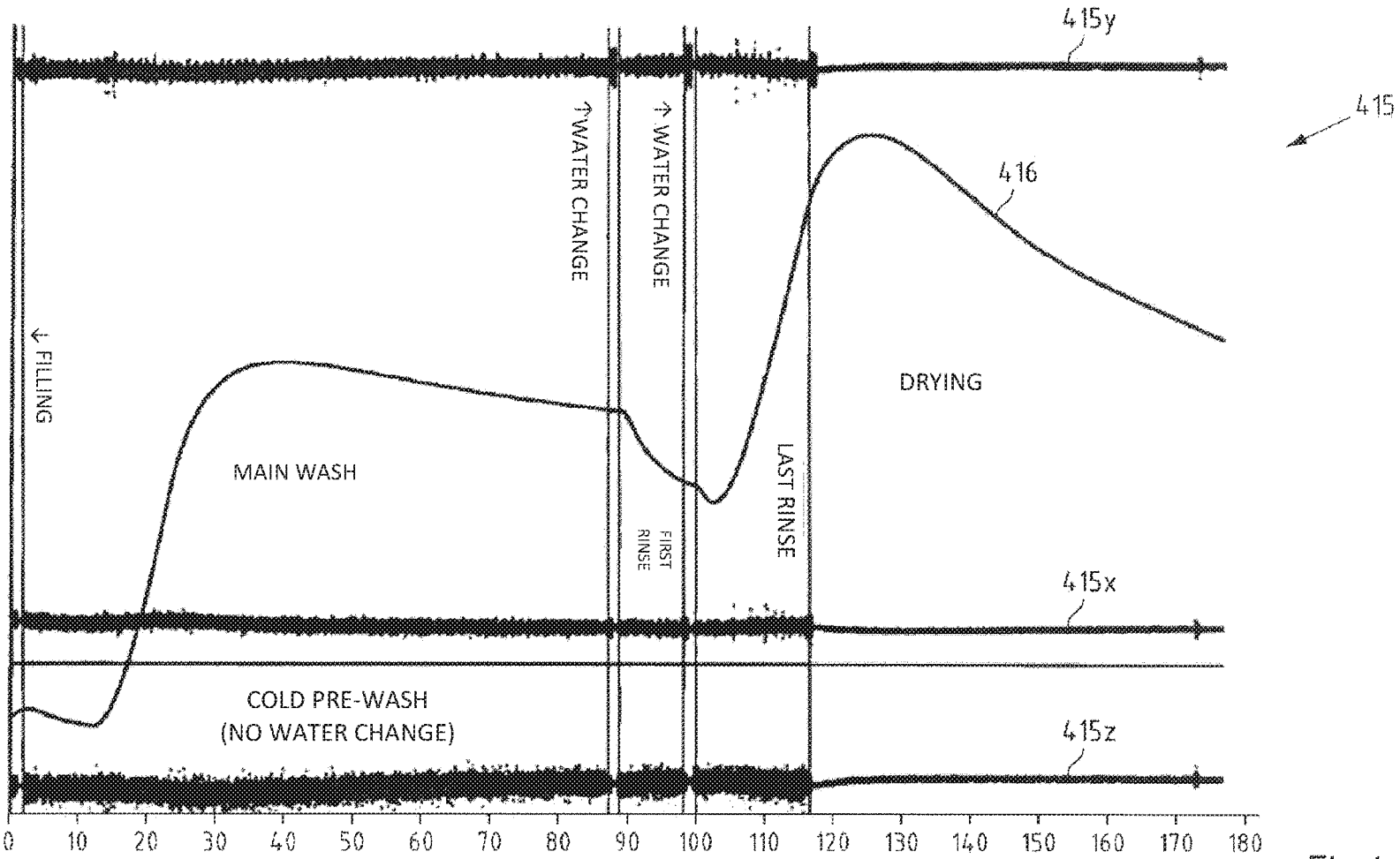
FIG. 4 shows a first exemplary progression represented by one set of acceleration data and one set of sensor data (see also the exemplary embodiment A described below)

Exemplary embodiment A—Conventional washing process of a cleaning program carried out by a dishwasher:

FIG. 4 shows acquired data 415 of an acceleration sensor (415*x*, 415*y*, 415*z*) and a temperature sensor (416) in one plot. The x-axis represents the time in minutes. The y1-axis of the progression of the acquired acceleration data (415*x*, 415*y*, 415*z*) shows the oscillation of the acceleration sensor. The y2-axis shows the progression of the temperature (416). The acceleration data (415*x*, 415*y*, 415*z*) and the sensor data indicative of the temperature (416) were acquired with a sampling rate of 10 Hz. The following process steps may be identified according to the designations in FIG. 4: Filling with water, pre-wash cold (no water exchange), main wash, water exchange, 1st rinse, final rinse and drying.

The acceleration sensor and the temperature sensor, which were used to acquire the data, are included in a dosing device (e.g. device 200 according to FIG. 1), which may be detachably placed in the treatment chamber of the dishwasher (e.g. device 300 according to FIG. 1). In the present case, the dosing device was placed upright in the lower basket of the treatment chamber and fixed between the plate holding devices of the lower basket. FIG. 4 shows the progression of the cleaning program on all axes of the acceleration sensor in combination with the temperature. The evaluation of the acquired (e.g. measured) acceleration data of the acceleration sensor in combination with the temperature allows a clear description of the cleaning program.

Surprisingly, despite the fixation of the dosing device in the basket, the acceleration sensor detects a significant vibration on all three axes (shown as oscillation in FIG. 4). The vibration is caused by the movement of the spray arms and the impact of water on the dosing device, as well as the running of the dishwasher's circulation pump. This makes the acceleration sensor suitable for determining whether a washing process has started or not (marked as "start of cycle identification" in FIG. 4). Compared to a running cleaning program, only a significantly reduced and uniform signal (marked as "silent noise" in FIG. 4) can be detected in all directions during the filling phase (see also FIG. 4 and FIG. 5).

Figure 5:
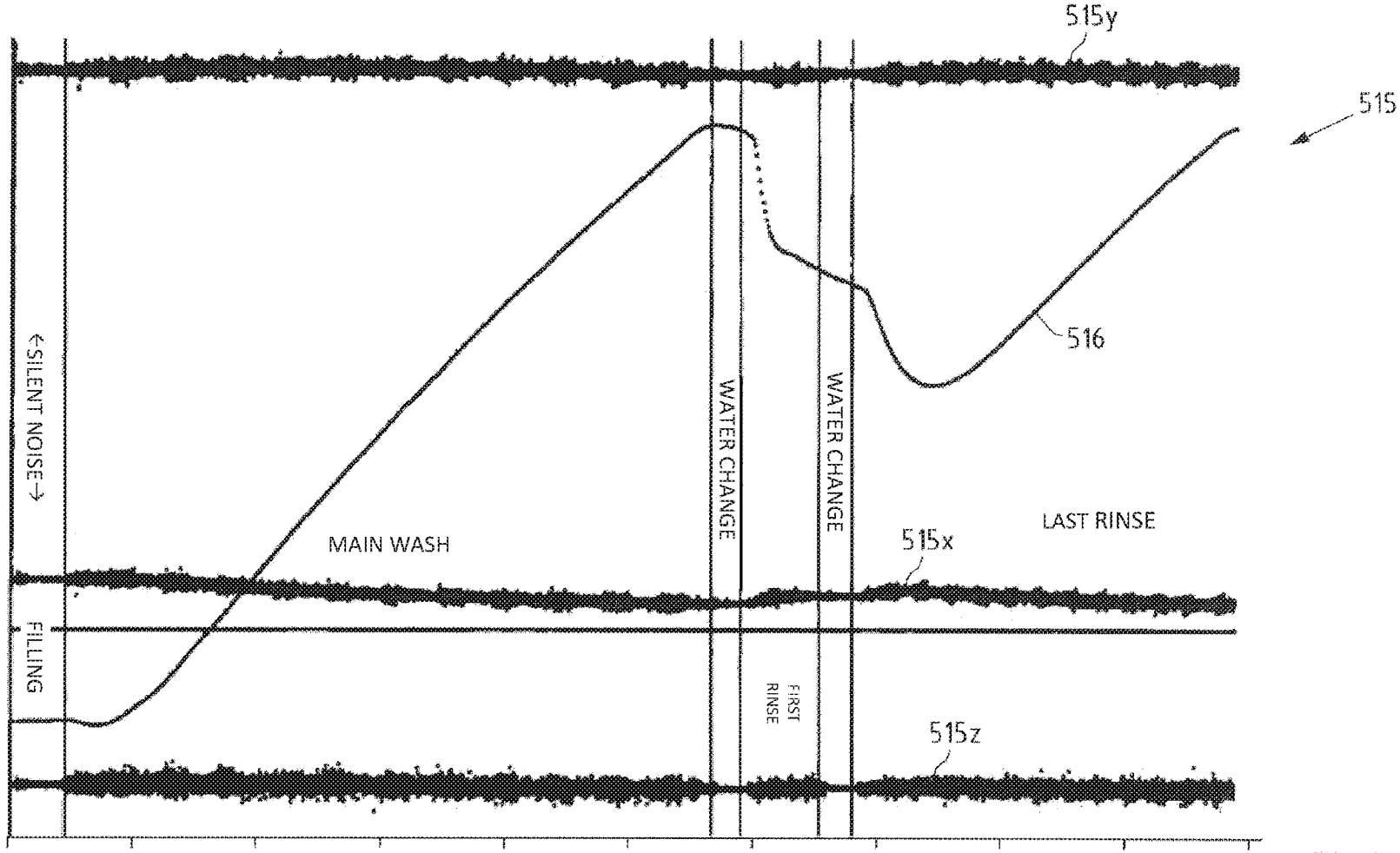
FIG. 5 shows a second exemplary progression represented by one set of acceleration data and one set of sensor data (see also the exemplary embodiment A described below)

FIG. 5 shows acquired data 515 from an acceleration sensor (515*x*, 515*y*, 515*z*) and a temperature sensor (516) in one plot. The x-axis represents the time in minutes. The y1-axis of the progression of the acquired acceleration data (515*x*, 515*y*, 515*z*) shows the oscillation of the acceleration sensor. The y2-axis shows the progression of the temperature (516). The acceleration data (515*x*, 515*y*, 515*z*) and the sensor data indicative of the temperature (516) were acquired with a sampling rate of 10 Hz. The following process steps may be identified according to the designations in FIG. 5: filling, main wash, water exchange, 1st rinse, final rinse.

By comparing the silent noise level with a current level, it is therefore possible to clearly determine whether a cleaning program has been started or not.

As long as the rinsing process of the cleaning program is active, the signal oscillates on all axes with different deflection. The degree of deflection depends on the placement of the dosing device and thus of the acceleration sensor. In FIG. 4, the acceleration sensor is placed upright on a board surrounded by the dosing device. With a defined (i.e. fixed) position of the dosing device, this results in defined axis directions. In the example in FIG. 4, the dosing device and thus also the board is parallel to the side walls of the dishwasher's treatment chamber. Thus the x-axis points towards the rear wall and door, the y-axis towards the lid and bottom and the z-axis towards the side walls on the left and right. The z-axis now clearly shows the strongest oscillations in comparison with the other axes. These oscillations are caused by the impact of the spray jet on the side surfaces of the dosing device and thus cause the acceleration sensor to move. This means that whenever stronger signals occur on the z-axis compared to the other axes, the dosing device is placed parallel to the side wall. If the signal is strongest on the x-axis, the dosing device is placed parallel to the door. This means that the position of the dosing device in the dishwasher can be clearly determined. This data may be used, for example, to give the user instructions on how to place the dosing device, or to give advice on how to solve any problems that may occur.

Exemplary embodiment B—Detection of a water change during a cleaning program performed by a dishwasher:

A self-sufficient measuring and/or dosing system, e.g. a dosing device (e.g. device 200 according to FIG. 1), should be able to identify individual program steps during a running cleaning program, in order to be able to guarantee, for example, an individual preparation of detergent. This is particularly important for a self-sufficient, automatic dosing device, because, depending on the timing of the rinsing process, dosing processes must be triggered in order to guarantee satisfactory performance for the user. Characteristic for every rinsing process are water changes, in which at least a part, usually the complete volume, is exchanged for fresh, usually cold water. Such water changes usually take place after a pre-rinse or pre-cleaning cycle, after a main wash or main cleaning cycle and after an intermediate wash cycle as part of the dishwasher's cleaning program (e.g. device 300 according to FIG. 1). They are exemplified by a pumping process in which the water from the previous rinse section is discharged with the aid of a waste water pump and a filling process in which the fresh water flows into the dishwasher. During these processes the rotation of the spray arm is stopped.

Figure 6:
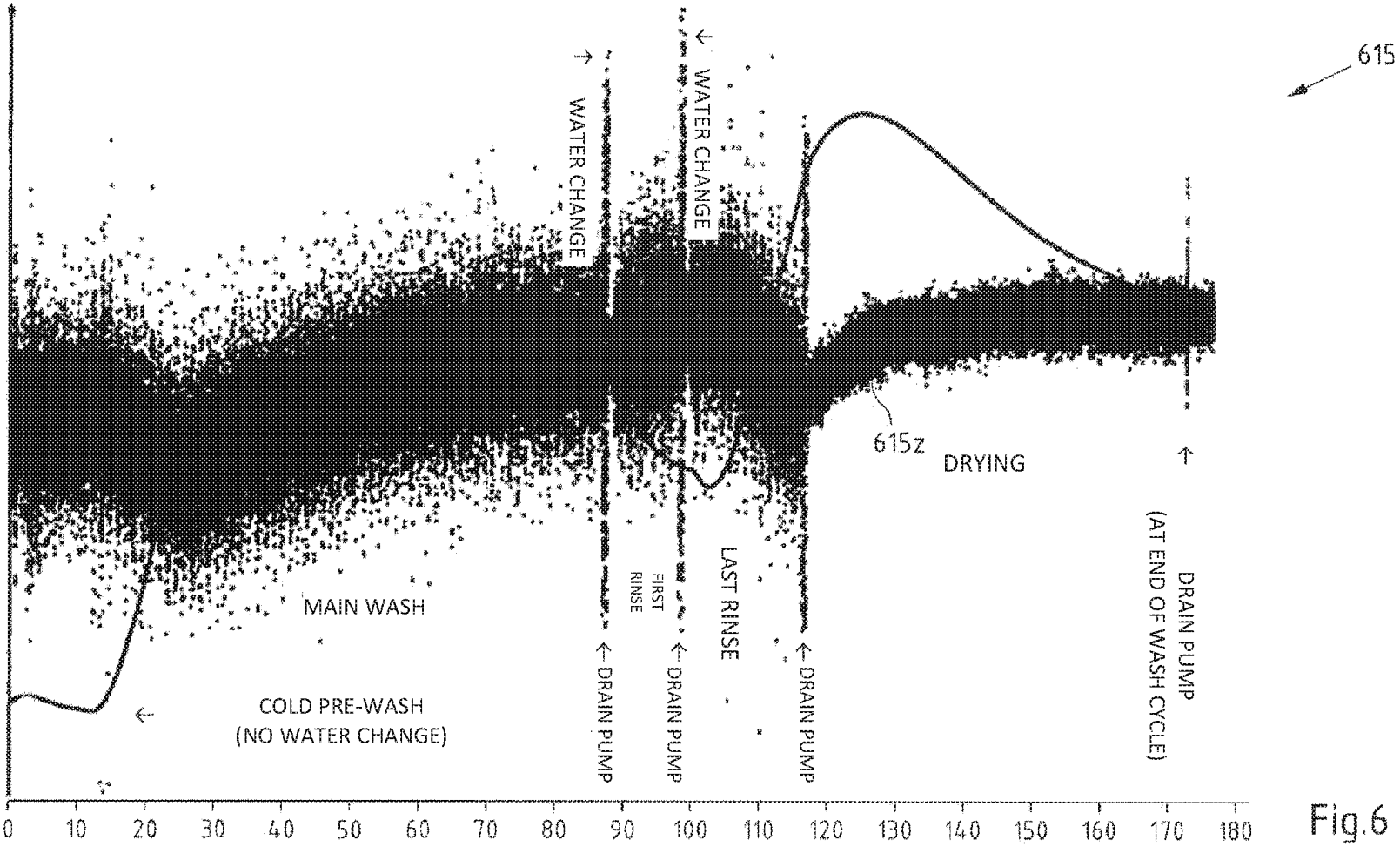
FIG. 6 shows a third exemplary progression represented by one set of acceleration data and one set of sensor data (see also the exemplary embodiment B described below)

FIG. 6 shows acquired data 615 from an acceleration sensor (615*y*) and a temperature sensor (616) in one plot. The x-axis represents the time in minutes. The y1-axis of the acquired acceleration data (615*y*) shows the oscillation of the acceleration sensor. The y2-axis shows the progression of the temperature (616). The acceleration data (615*y*) and the sensor data indicative of the temperature (616) were acquired with a sampling rate of 10 Hz. The following process steps are identified according to the designations in FIG. 6: pre-wash cold (no water exchange), main wash, drain pump, 1st rinse, final rinse and drying.

FIG. 6 shows several water changes on the y-axis of a progression represented by acquired acceleration sensor data. The y-axis is particularly sensitive to the processes because its orientation points towards the machine floor, among other things. The acceleration sensor first detects the vibration of the waste water pump (marked "drain pump" in FIG. 6). This is followed by a rest period without spraying arm movement, during which the water flows in. The combination of the two processes clearly describes the water change. If the signal of the acceleration sensor is combined with a signal as temperature data acquired by a temperature sensor, the process may be described unambiguously. This is because if cold water flows into the machine, the interior temperature drops significantly after restarting the circulation pump (in FIG. 6 marked with "first rinse" or at the beginning of the section "final rinse").

It is therefore possible to unambiguously determine a water change by identifying a pumping process and/or a possible subsequent rest period based on acceleration data acquired by an acceleration sensor and temperature data acquired by a temperature sensor.

In the event that the pumping process cannot be clearly identified, e.g. due to the placement of the dosing device, it is sometimes also sufficient to combine the rest phase and the temperature drop after restarting as a unique signal and to conclude from this that a water change has occurred. When the rest phase is identified, the dosing device may, for example, start a timer to monitor when movement is detected again on the axes of the acceleration sensor, which detects movement of the acceleration sensor on these axes. If this takes place within a defined time window and the temperature drops within a defined time window, the water change is also reliably detected here.

The reliable detection of water changes is very important for the description of the entire washing process or of a cleaning program carried out by the dishwasher, because it must be clearly distinguished whether the subsequent rinse cycle of the cleaning program is a cleaning cycle, an intermediate rinse cycle or a rinse cycle.

Exemplary embodiment C—Recognition of a drying cycle of a cleaning program carried out by a dishwasher:

After the final rinse (see embodiment B above) the dishwasher (e.g. device 300 according to FIG. 1) starts the drying phase. In the drying phase, the dishes dry on the basis of the energy stored in the previous rinse (corresponding to the heat capacities of the different dish materials). However, in the drying phase the spray arms are now no longer moved. Similar to the embodiment A of filling, drying is a distinct "silent noise" phase, as no water is circulated, for example. This means that the drying phase may clearly be distinguished from the preceding rinse cycle on all axes of the acceleration sensor by comparing the oscillations (cf. FIG. 6 and FIG. 7).

Figure 7:
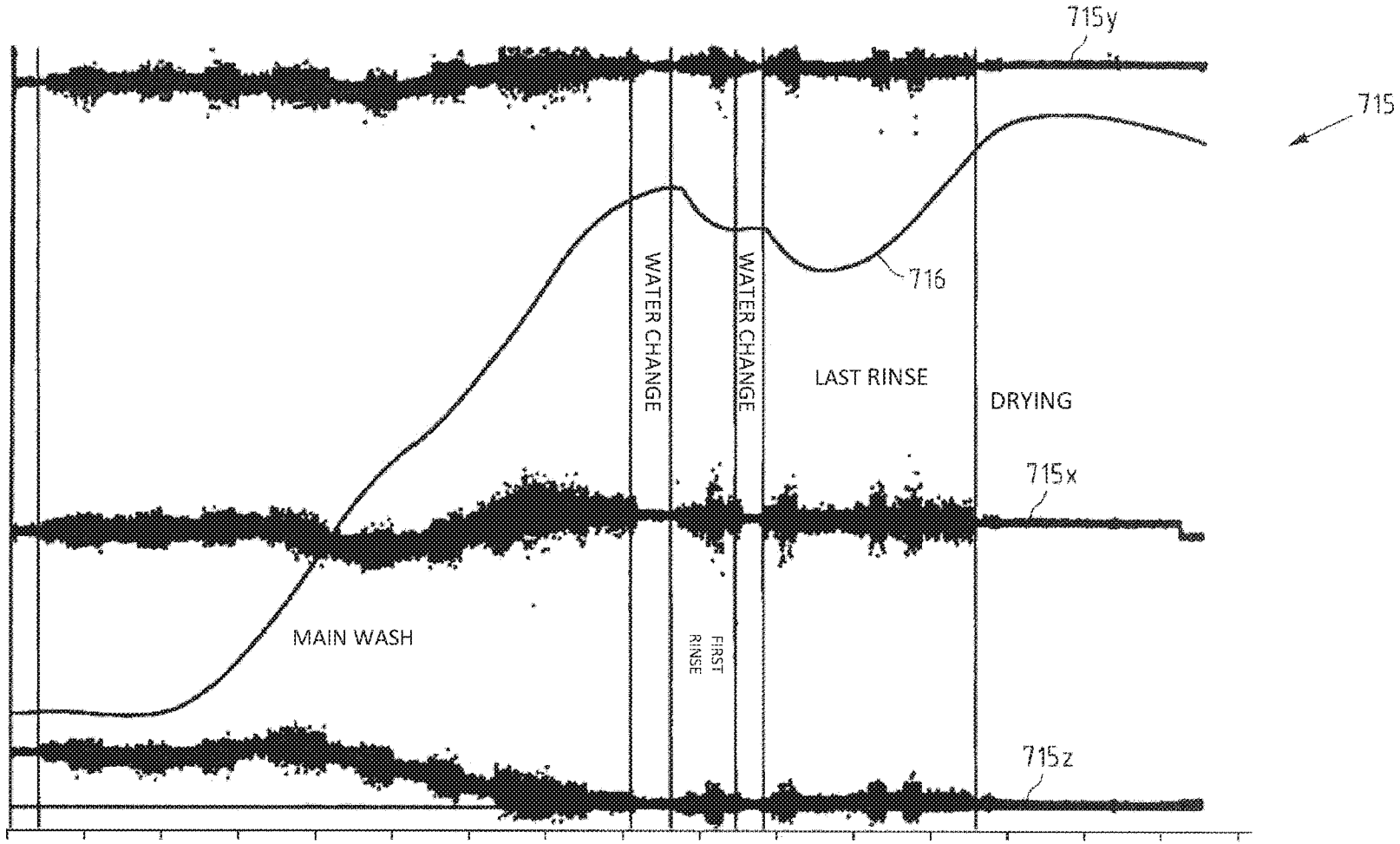
FIG. 7 shows a fourth exemplary progression represented by one set of acceleration data and one set of sensor data (see also the exemplary embodiment C described below)

FIG. 7 shows acquired data 715 of an acceleration sensor (715*x*, 715*y*, 715*z*) and a temperature sensor (716) in one plot. The x-axis represents the time in minutes. The y1-axis of the progression of the acquired acceleration data (715*x*, 715*y*, 715*z*) shows the oscillation of the acceleration sensor. The y2-axis shows the progression of the temperature (716). The acceleration data (715*x*, 715*y*, 715*z*) and the sensor data indicative of the temperature (716) were acquired with a sampling rate of 10 Hz. The following process steps may be recognized according to the designations in FIG. 7: main wash, water exchange, 1st rinse, final rinse and drying).

As can be clearly seen in FIG. 7, the dishwasher stops the spray arm rotation between minute 62 and minute 63. The water is pumped out and the dishes dry using their own heat. For the user, the waiting period now begins, during which the dishwasher is supposedly inactive. A self-sufficient dosing device (e.g. device 200 according to FIG. 1) may, for example, start a timer when the waiting time begins. If the timer exceeds a defined value and no more movement is detected by the acceleration sensor on all axes, it may be clearly assumed that the drying phase has begun.

It is therefore necessary to compare an active level with a current level to determine whether the spray arm movement has ended or not. Furthermore, by combining the acceleration data with a time measurement, a clear identification of the drying process, which is carried out as part of the cleaning program of a dishwasher, may be carried out.

Figure 8:
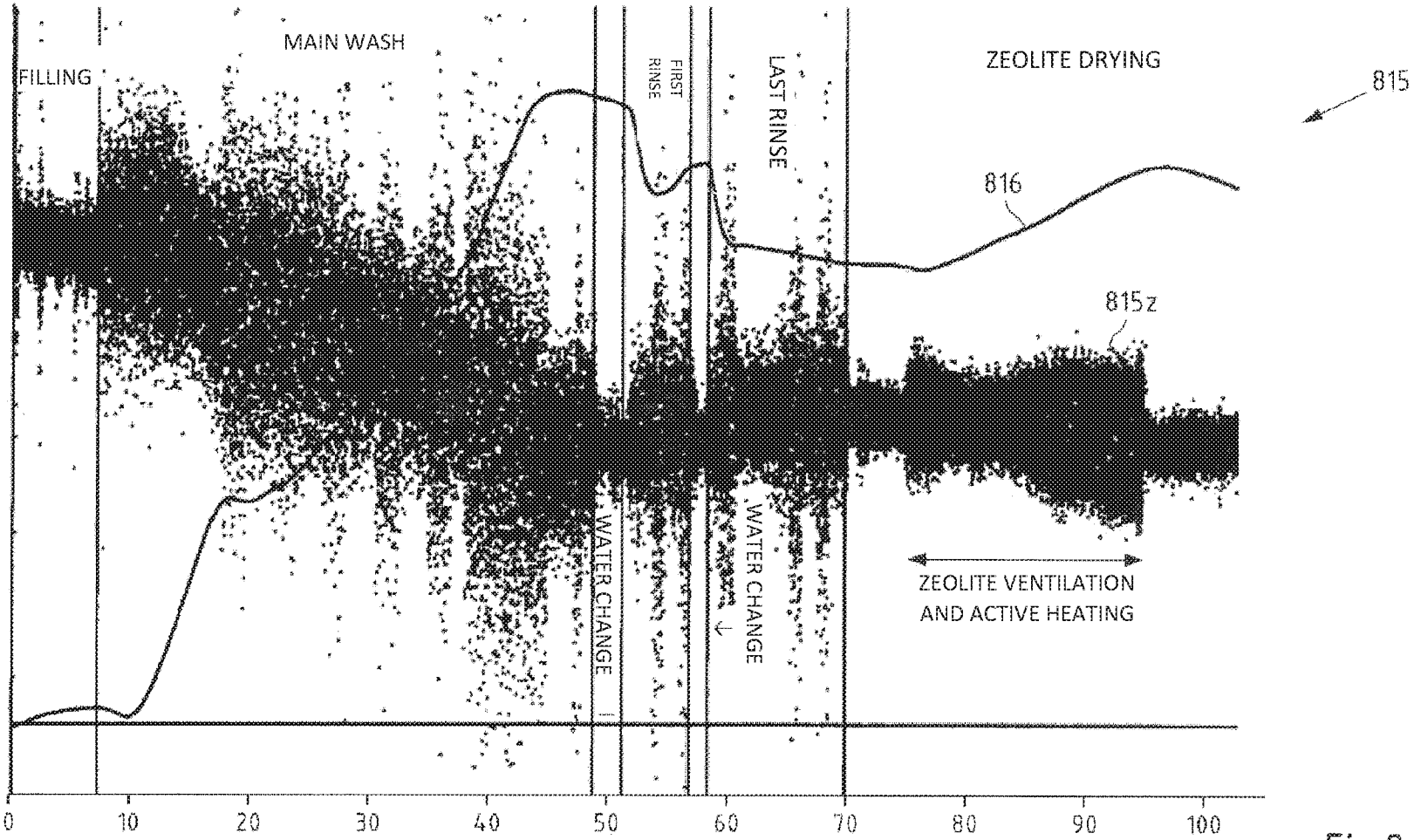
FIG. 8 shows a fifth exemplary progression represented by one set of acceleration data and one set of sensor data (see also the exemplary embodiment C described below)

FIG. 8 shows acquired data 815 of an acceleration sensor (815*z*) and a temperature sensor (816) in one plot. The x-axis represents the time in minutes. The y1-axis of the progression of the acquired acceleration data (815*z*) shows the oscillation of the acceleration sensor. The y2-axis shows the progression of the temperature (816). The acceleration data (815*z*) and the sensor data indicative of the temperature (816) were acquired with a sampling rate of 10 Hz. The following process steps may be recognized according to the designations in FIG. 8: filling, main wash, water exchange, 1st rinse, final rinse, and zeolite drying comprising ventilation and heating.

In exemplary embodiments the drying process is e.g. a thermally activated drying process, also called zeolite drying method. In an ideal washing process, this method dispenses with heating the dishes in the final rinse cycle; in fact, the dishes may even cool down slightly (cf. FIG. 8). The transition to the drying cycle may now be determined again by level comparison. However, the timer in combination with the motion signal would now detect oscillation on all axes again after approx. 5 minutes, because in the so-called zeolite drying method, a fan then starts which conveys the moist air to the zeolite adsorber. There the water contained in the air is absorbed on the zeolite. As the adsorption is an exothermic process, the dried air flowing back into the rinsing tank is heated up strongly, which leads to an increase in the interior temperature. This means that in the special case of zeolite, the temperature rises again significantly during drying. This process may again be clearly identified with the acceleration sensor in combination with a temperature sensor, and thus also the special case of the zeolite drying method, because in no other dishwasher (e.g. European design) is the drying process actively heated.

It is therefore possible to identify zeolite-active rinse cycles in the drying process of a dishwasher cleaning program by a combination of acquired acceleration data and temperature data.

Exemplary embodiment D—End-of-cycle detection of a cleaning program performed by a dishwasher:

The recognition of the true end of a wash cycle is not easily possible for a self-contained dosing device (e.g. device 200 according to FIG. 1). An end of the oscillation phase initially means the start of the drying phase of a cleaning program performed by a dishwasher (e.g. device 300 according to FIG. 1) and has nothing to do with the absolute end of the wash cycle.

Figure 9:
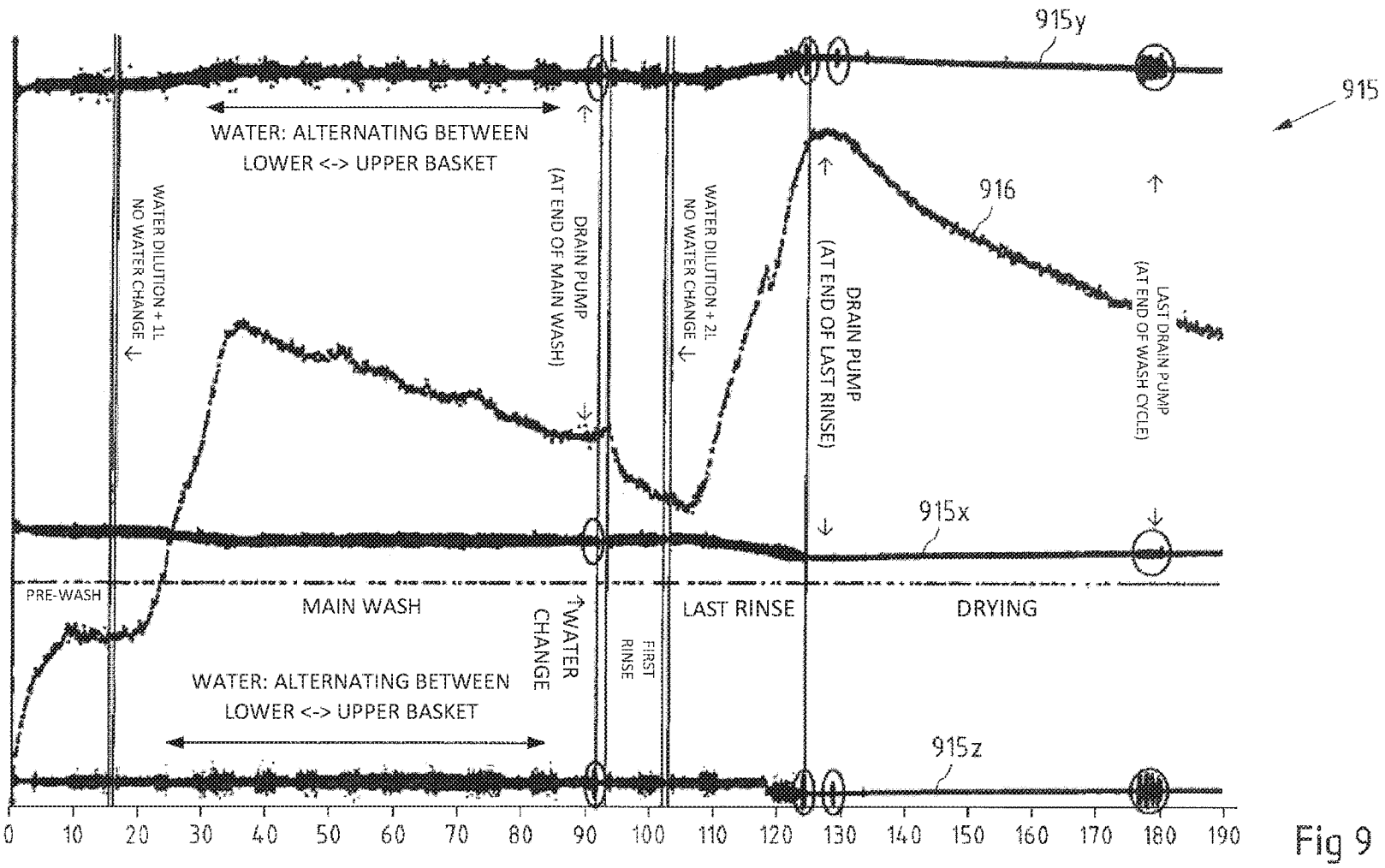
FIG. 9 shows a sixth exemplary progression represented by one set of acceleration data and one set of sensor data (see also the exemplary embodiment D described below)

FIG. 9 shows acquired data 915 from an acceleration sensor (915*x*, 915*y*, 915*z*) and a temperature sensor (916) in one plot. The x-axis represents the time in minutes. The y1-axis of the progression of the acquired acceleration data (915*x*, 915*y*, 915*z*) shows the oscillation of the acceleration sensor. The y2-axis shows the progression of the temperature (916). The acceleration data (915*x*, 915*y*, 915*z*) and the sensor data indicative of the temperature (916) were acquired with a sampling rate of 10 Hz. The following process steps may be identified according to the designations in FIG. 9: Pre-wash, water dilution, main wash, pumping after the main wash ("pumping (end of main cycle)"), water exchange, 1st rinse, final rinse, pumping after the final rinse ("pumping (end of final rinse cycle)"), drying and final pumping.

Figure 10:
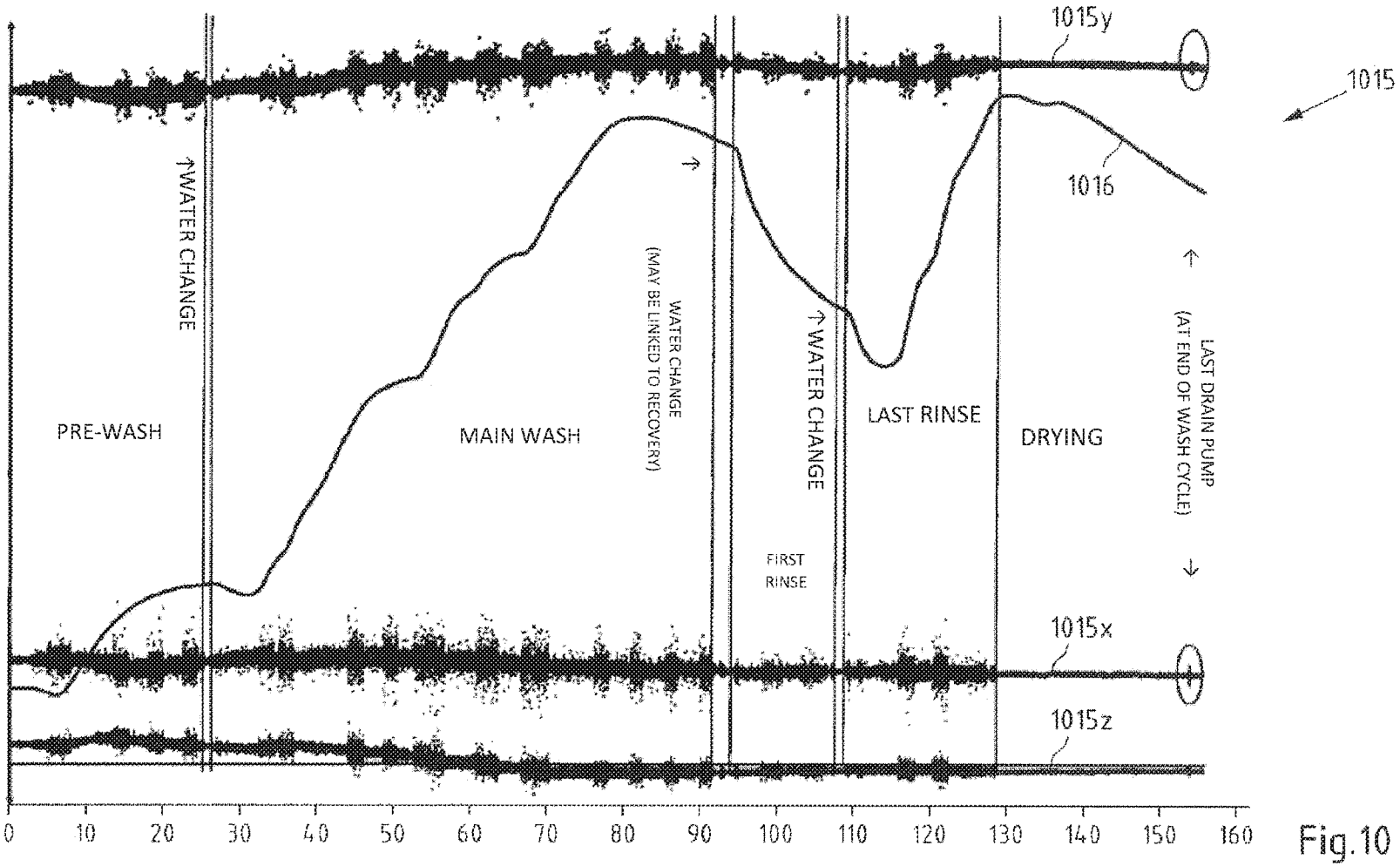
FIG. 10 shows a seventh exemplary progression represented by one set of acceleration data and one set of sensor data (see also the exemplary embodiment D described below)

FIG. 10 shows acquired data 1015 from an acceleration sensor (1015*x*, 1015*y*, 1015*z*) and a temperature sensor (1016) in one plot. The x-axis represents the time in minutes. The y1-axis of the progression of the acquired acceleration data (1015*x*, 1015*y*, 1015*z*) shows the oscillation of the acceleration sensor. The y2-axis shows the progression of the temperature (1016). The acceleration data (1015*x*, 1015*y*, 1015*z*) and the sensor data indicative of the temperature (1016) were acquired with a sampling rate of 10 Hz. The following process steps may be recognized according to the designations in FIG. 10: pre-wash, main wash, water exchange, 1st rinse, final rinse, drying and final pumping.

Figure 11:
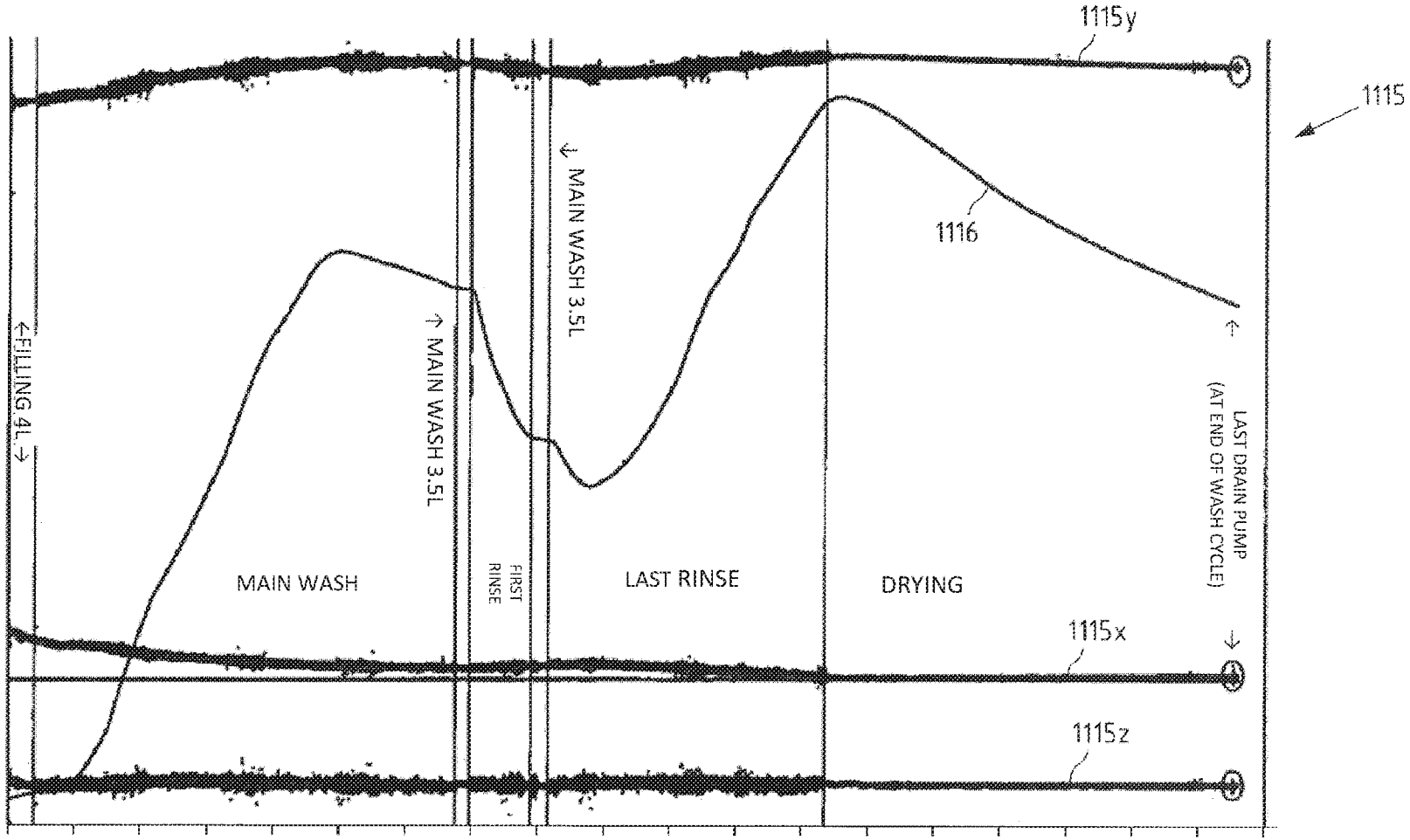
FIG. 11 shows an eighth exemplary progression represented by one set of acceleration data and one set of sensor data (see also the exemplary embodiment D described below).

FIG. 11 shows acquired data 1115 from an acceleration sensor (1115*x*, 1115*y*, 1115*z*) and a temperature sensor (1116) in one plot. The x-axis represents the time in minutes. The y1-axis of the progression of the acquired acceleration data (1115*x*, 1115*y*, 1115*z*) shows the oscillation of the acceleration sensor. The y2-axis shows the progression of the temperature (1116). The acceleration data (1115*x*, 1115*y*, 1115*z*) and the sensor data indicative of the temperature (1116) were acquired with a sampling rate of 10 Hz. The following process steps may be recognized according to the designations in FIG. 11: filling, main wash, water exchange, 1st rinse, final rinse and drying.

The end of the rinse cycle is typically indicated to the consumer by an audible signal or a message on the display. However, a dosing device in the dishwasher's treatment chamber does not have this option. Many dishwasher cleaning programs, for example, conclude the drying phase with one or more pumping steps to remove condensate and residual liquor. The running of the waste water pump in turn causes sufficient vibrations, which can be detected by an acceleration sensor (cf. FIGS. 9, 10, and 11, "final pumping").

It is therefore possible, through a combination of acceleration data and acquired time measurement values, e.g. time data acquired with a timer, to identify the end of a cleaning program by the acceleration data and time data acquired during a drying process of the cleaning program.

Exemplary embodiment E—Use of the findings:

A dosing device (e.g. device 200 according to FIG. 1) with appropriate sensor equipment (in particular an acceleration sensor included in it) may, for example, be used to examine, monitor and communicate each individual rinse cycle of a dishwasher (e.g. device 300 according to FIG. 1). All sensor data (in particular acceleration data, temperature data and time data) may be stored in a database and evaluated. The storage and evaluation may be done locally, but preferably in a remote system (e.g. server or server cloud). The data may also be optionally fed into a machine learning tool, e.g. to recognize data patterns. The data patterns may be used, for example, to give the user feedback on his app, to point out problems or to control a dosing device.

The following is an example:

A user of a (stand-alone) dosing device (e.g. device 200 according to FIG. 1) selects a specific cleaning program on his dishwasher, but always the same (as shown in FIG. 4). The dosing device observes the progress of the cleaning program. In a conventional setting, the dosing device would dose detergent, e.g. if it detected a spray arm movement and a rise in temperature. Now, however, the dosing device could learn to dose earlier, because the pattern of the cleaning program is recognized early. This significantly extends the cleaning time with chemicals present, for example, and thus achieves an improved cleaning result.

In another example, a user of such a (self-sufficient) dosing device uses a cleaning program with a long cleaning duration during the week, and during the weekends always cleaning programs with short cleaning duration. With the acquired data, a user profile may be created and, for example, the amount of detergent to be dosed may be adjusted to the respective cleaning programs during the week and on weekends.

In principle, one or more of the following aspects apply to all aspects of the present disclosure:

- all data may be stored locally and remotely;
- all data may be subjected to additional data analysis;
- all data may be edited with a machine learning tool;
- conclusions about user behavior may be drawn from the data;
- user profiles may be created from the data; and
- from the results of the data analysis and/or machine learning, algorithms (instructions) for the operation of a self-sufficient dosing device may be derived.

Terms used in the Claims such as "comprising", "having", "containing", "containing" and the like do not exclude further elements or steps. The expression "at least partially" covers both the "partially" case and the "completely" case. The wording "and/or" should be understood to mean that both the alternative and the combination should be disclosed, i.e. "A and/or B" means "(A) or (B) or (A and B)". The use of the indefinite article does not exclude a plural. A single device may perform the functions of several units or devices mentioned in the Claims. Reference marks indicated in the Claims should not be regarded as limitations of the features and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A method of optimizing dispensing of a cleaning agent in a dishwasher comprising:

detecting at least one set of acceleration data indicative of a progression of measured acceleration values, wherein the at least one set of acceleration data is detected by at least one acceleration sensor in a treatment chamber of the dishwasher, the at least acceleration sensor being part of a separate dosing device for dispensing the cleaning agent positioned in the treatment chamber of the dishwasher, and wherein the separate dosing device is configured to be removably placed within the treatment chamber of the dishwasher;

determining status data indicative of a current process step within a cleaning program being performed by the dishwasher, wherein the status data is determined partly based on the at least one set of acceleration data;

detecting at least one set of sensor data indicative of a variation in temperature within the treatment chamber or an elapsed time of the cleaning program, wherein the at least one set of sensor data is detected by at least one sensor in the treatment chamber of the dishwasher;

further determining the status data partly based also on the at least one set of sensor data;

outputting or causing the output of the determined status data that was determined partly based on the at least one set of acceleration data and partly based also on the at least one set of sensor data; and determining control data at least partially based on the status data, wherein the control data causes the dosing device to perform a dosing of cleaning agent into the treatment chamber of the dishwasher;

wherein the at least one set of acceleration data represent signals from directions of each of two or three degrees of freedom with respect to a Cartesian coordinate system, and wherein an orientation or placement of the dosing device in the treatment chamber of the dishwasher is determined based on a comparison between the acceleration data in the directions of all of the two or three degrees of freedom represented by the at least one set of acceleration data.

2. The method according to claim 1, wherein the status data represents one or more process steps i) to xi) of the cleaning program:

i) start of the cleaning program;
ii) performing filling with water during the cleaning program;
iii) performing a water change during the cleaning program;
iv) performing a pre-rinse during the cleaning program;
v) performing a main cleaning cycle during the cleaning program;
vi) performing a first rinse during the cleaning program;
vii) performing further rinsing steps during the cleaning program;
viii) performing a final rinse during the cleaning program;
ix) performing a drying process during the cleaning program;
x) performing a zeolite-active drying process during the cleaning program; and
xi) end of the cleaning program.

3. The method according to claim 1, wherein the at least one set of sensor data is acquired from a temperature sensor or a timer.

4. The method according to claim 1, wherein the at least one set of acceleration data and the at least one set of sensor data are acquired in parallel.

5. The method according to claim 1, wherein the at least one set of acceleration data and/or the at least one set of sensor data are each acquired over a predefined period of time.

6. The method according to claim 1, wherein acceleration data is separately collected for each of the two or three degrees of freedom.

7. The method according to claim 1, wherein the determination of the status data is further based on one or more of the following characteristics:

a noise level represented by said at least one set of acceleration data;

a progression represented by the at least one set of acceleration data compared with a progression represented by temperature data; and a progression represented by the at least one set of acceleration data compared with a progression represented by time data.

8. The method according to claim 1, further comprising:

creating a set of user profile data at least partially based on the at least one set of acceleration data and the at least one set of sensor data, the status data being further determined partly based on the user profile data.

9. The method of claim 8, wherein the control data is further determined based on the user profile data, and wherein the control data causes a dosing device to perform adjusted dosing of the cleaning agent.

10. The method of claim 8, wherein the control data is further determined based on the user profile data, and wherein the control data includes instructions on how to place the dosing device in the treatment chamber of the dishwasher.

11. The method of claim 8, wherein the control data is further determined based on the user profile data, and wherein the control data includes advice on how to solve a problem that may occur during a cleaning cycle.

12. The method of claim 1, wherein the at least one sensor is part of the separate dosing device.

13. The method of claim 1, wherein the at least one sensor is part of the dishwasher.

14. A non-transitory computer-readable medium comprising a computer program with instructions which cause a processor to execute the method according to claim 1 when the computer program is executed by the processor.

* * * * *